US012121132B2

(12) United States Patent
Hamze

(10) Patent No.: US 12,121,132 B2
(45) Date of Patent: Oct. 22, 2024

(54) MODULAR MULTI-LAYER MULTI-COMPARTMENT COSMETICS CONTAINER

(71) Applicant: Hassan Sobhi Hamze, Sayville, NY (US)

(72) Inventor: Hassan Sobhi Hamze, Sayville, NY (US)

( * ) Notice: Subject to any disclaimer, the term of this patent is extended or adjusted under 35 U.S.C. 154(b) by 285 days.

(21) Appl. No.: 17/737,138

(22) Filed: May 5, 2022

(65) Prior Publication Data

US 2022/0312938 A1 Oct. 6, 2022

Related U.S. Application Data

(63) Continuation-in-part of application No. 15/136,903, filed on Apr. 23, 2016, now Pat. No. 11,344,090.

(51) Int. Cl.

| | |
|---|---|
| ***B65D 21/02*** | (2006.01) |
| ***A45D 33/22*** | (2006.01) |
| ***A45D 40/24*** | (2006.01) |
| ***B65D 25/04*** | (2006.01) |
| ***B65D 43/16*** | (2006.01) |
| *A45D 33/00* | (2006.01) |
| *A45D 40/22* | (2006.01) |

(52) U.S. Cl.

CPC ..... *A45D 40/24* (2013.01); *A45D 33/22* (2013.01); *B65D 21/0204* (2013.01); *B65D 25/04* (2013.01); *B65D 43/164* (2013.01); *A45D 33/008* (2013.01); *A45D 2040/223* (2013.01); *A45D 2040/224* (2013.01); *A45D 2040/225* (2013.01); *A45D 2200/25* (2013.01)

(58) Field of Classification Search

CPC .. B65D 21/0204; B65D 25/04; B65D 43/164; A45D 33/22; A45D 33/008; A45D 40/24; A45D 2040/223; A45D 2040/225; A45D 2200/25

USPC ..... 206/581, 823; 220/4.26, 4.27, 4.29, 836, 220/843, 848

See application file for complete search history.

(56) References Cited

U.S. PATENT DOCUMENTS 1,688,042 A * 10/1928 Gaess ..... A45D 33/006 206/229
3,188,157 A * 6/1965 Rand ..... A47B 87/0292 220/23.8
3,392,868 A * 7/1968 Pfrommer ..... A45D 40/24 D9/422

(Continued)

*Primary Examiner* — Luan K Bui

(57) ABSTRACT

A modular multi-compartment cosmetics container assembly may have plurality of layers configured to releasably couple to each other, permitting a user to attach and detach various different compartment layers, or to just shuffle multiple compartment layers that may store different items into more desirable positions in the arrangement. Releasable attachment is provided by each compartment layer being formed with a hinge pin proximate to a top portion of a side wall of the compartment, and a hinge knuckle disposed proximate to a bottom portion of the side wall, where the hinge knuckle has an opening permitting it to clip onto the hinge pin of the adjacent compartment layer. A latch releasably secures each compartment layer in a closed position. Each hinge knuckle and latch may be pivotally mounted to its compartment layer, permitting movement into a retracted position, so the compartment can sit flush on a flat surface.

4 Claims, 42 Drawing Sheets

(56) References Cited

U.S. PATENT DOCUMENTS

| | | | | | |
|---|---|---|---|---|---|
| 4,165,815 | A * | 8/1979 | Vetter | A45D 40/0068 | 220/4.27 |
| 4,239,308 | A * | 12/1980 | Bradley | A45C 11/16 | 312/226 |
| 4,589,431 | A * | 5/1986 | Yuhara | A45C 13/005 | 132/301 |
| 4,807,773 | A * | 2/1989 | Tsai | A45D 33/24 | 206/823 |
| 6,070,749 | A * | 6/2000 | Joulia | A45D 40/221 | 220/817 |
| 6,961,977 | B2 * | 11/2005 | Seidler | A45D 40/24 | 220/816 |
| 7,055,216 | B2 * | 6/2006 | Seidler | A45D 40/24 | 16/320 |

* cited by examiner

Female /Female

Female / Male

Female / Hinge

Female / Push

Female / Cover

Push / Male

Male / Male

Hinge / Male

Hinge / Twist

Male / Cover

Push / Push

Hinge / Push

Hinge / Hinge

Twist / Male

Push / Cover

FIG. 26A
Square with Hinge / Round Male
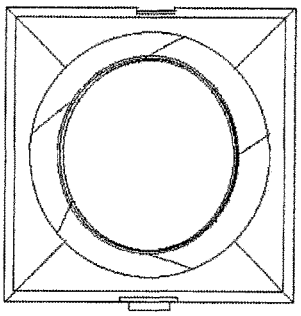
FIG. 26B
Rectangle with hinges / Ovel Push
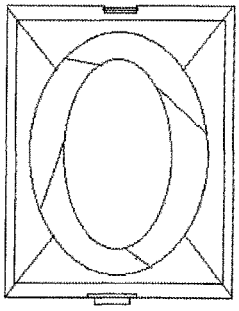
FIG. 26C
Square with Hinge / Female Threads
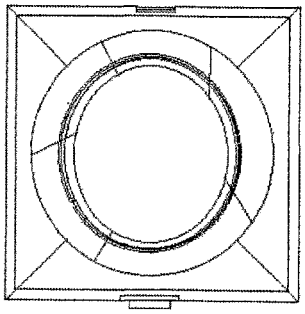
FIG. 26D
Female with push rectangle
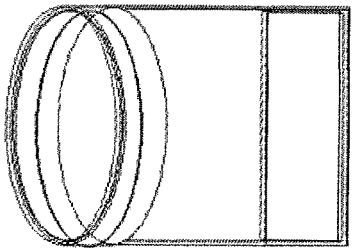
FIG. 26E
Male with hinged rectangle
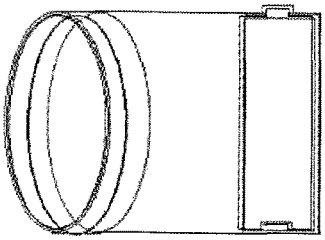
Female FIG. 26F
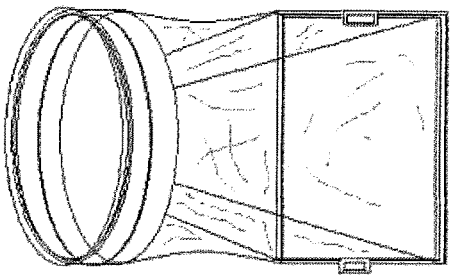
Male FIG. 26G
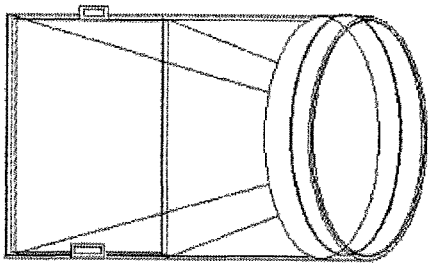
FIG. 26H
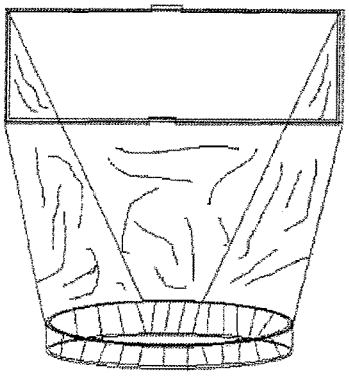
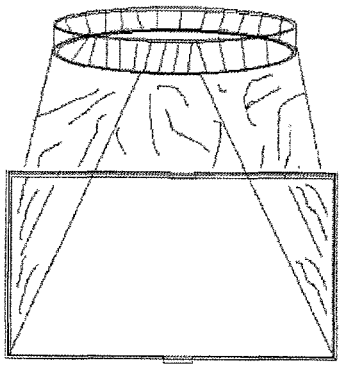
FIG. 26J FIG. 29
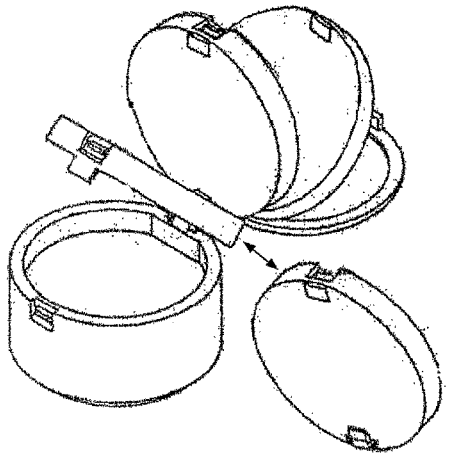
FIG. 28
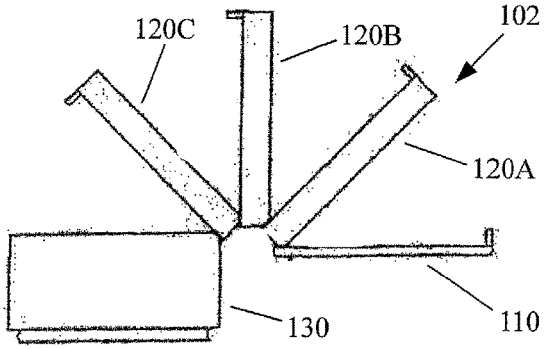
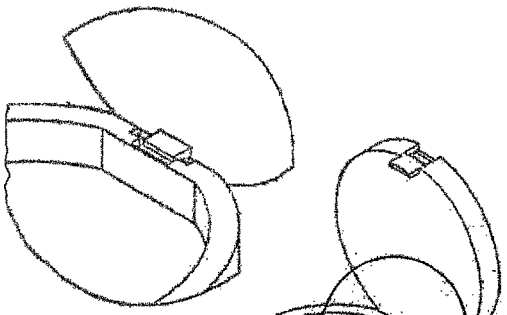
FIG. 30A
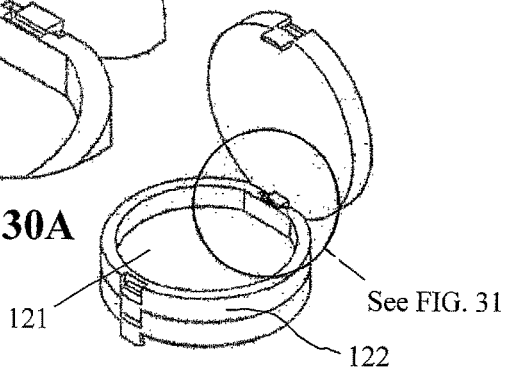
FIG. 30
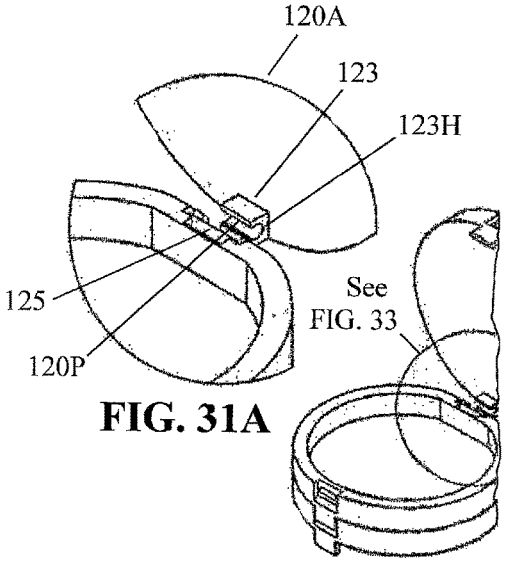
FIG. 31A
FIG. 31
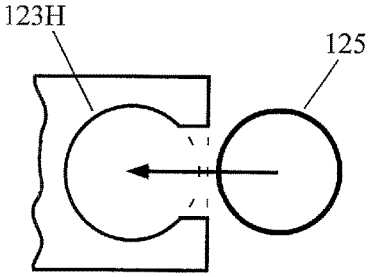
FIG. 31BB
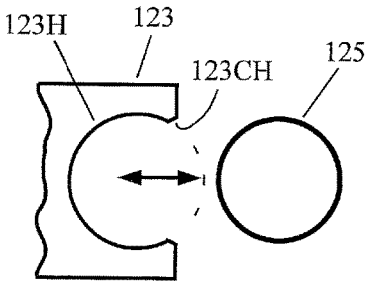
FIG. 31B
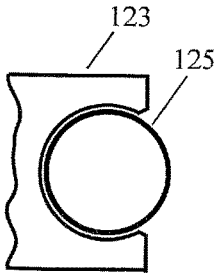
FIG. 31C FIG. 32
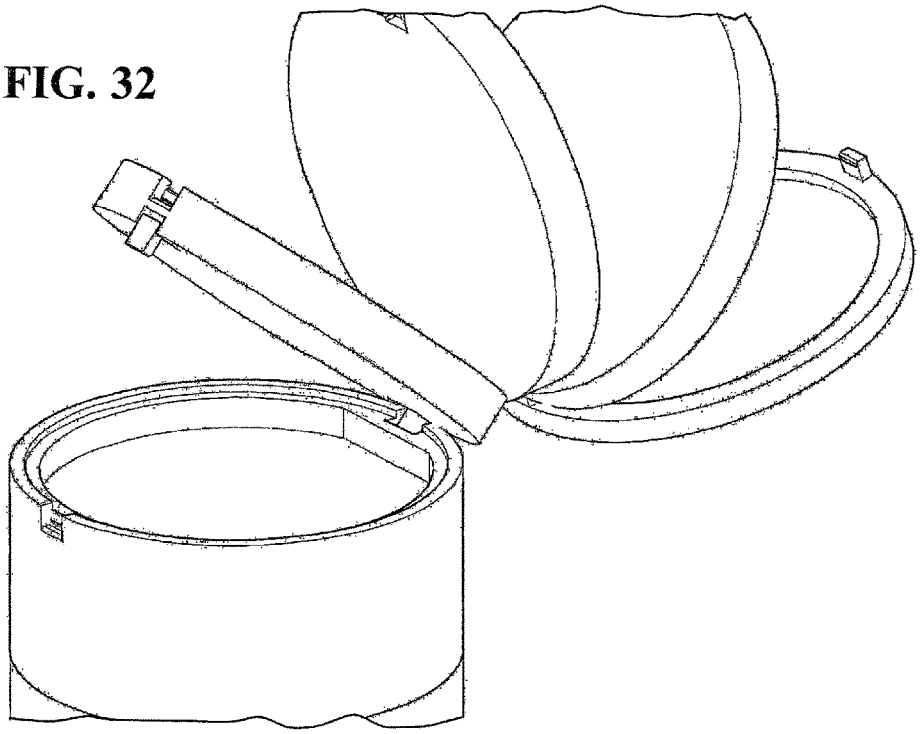
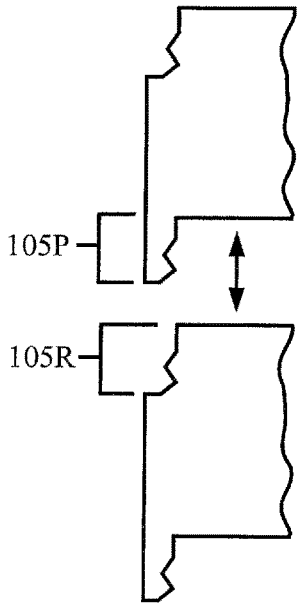
FIG. 32A
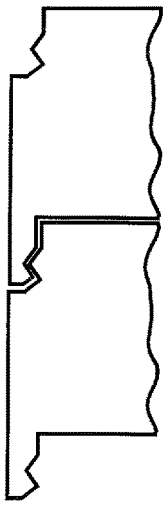
FIG. 32B
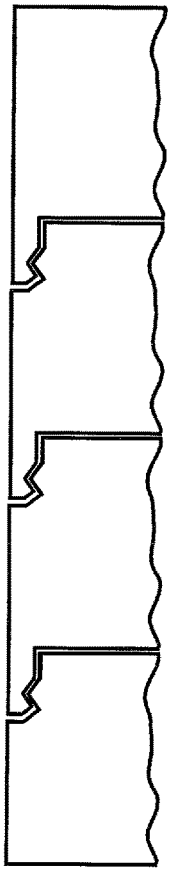
FIG. 32C FIG. 42
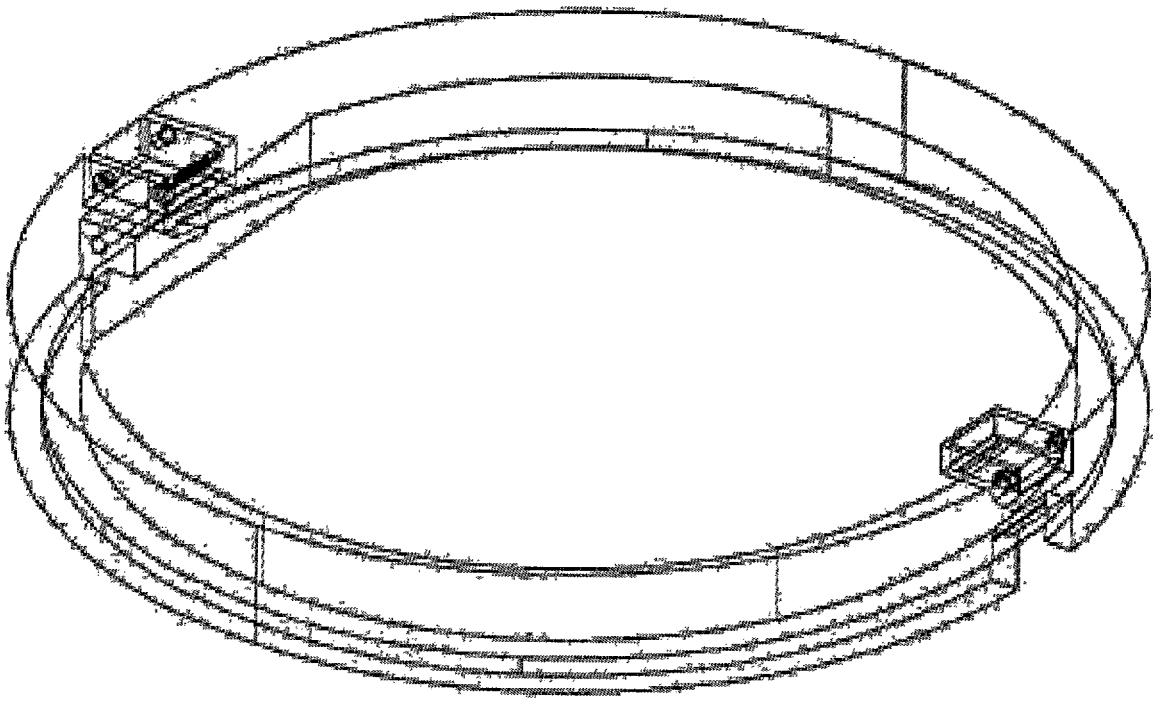
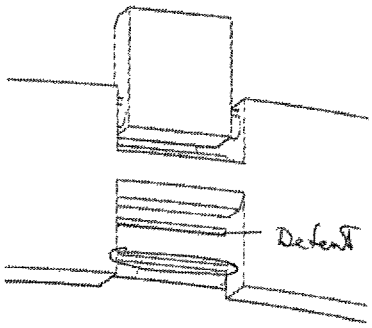
FIG. 42A

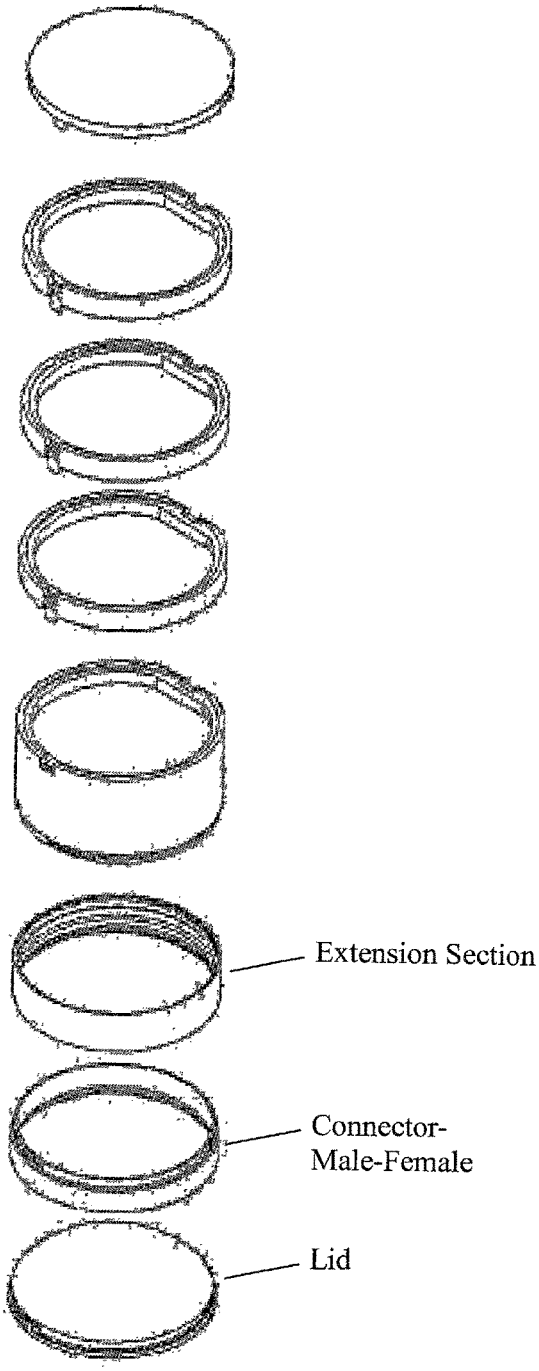
FIG. 43
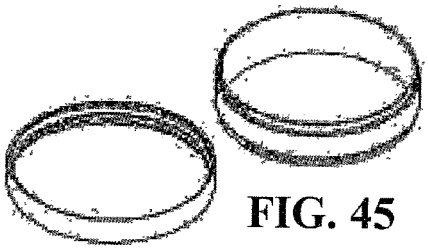
FIG. 45
FIG. 44

FIG. 48
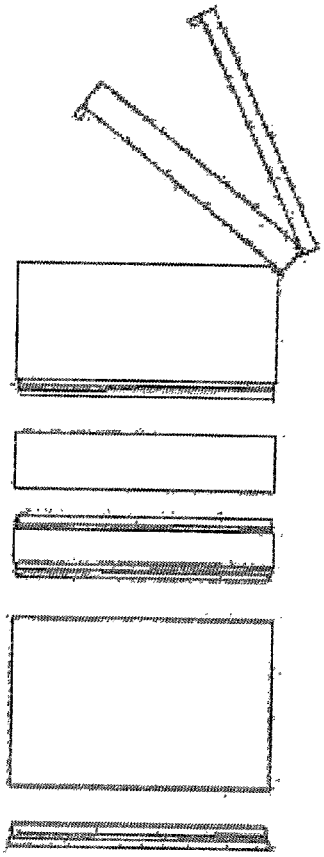
FIG. 49
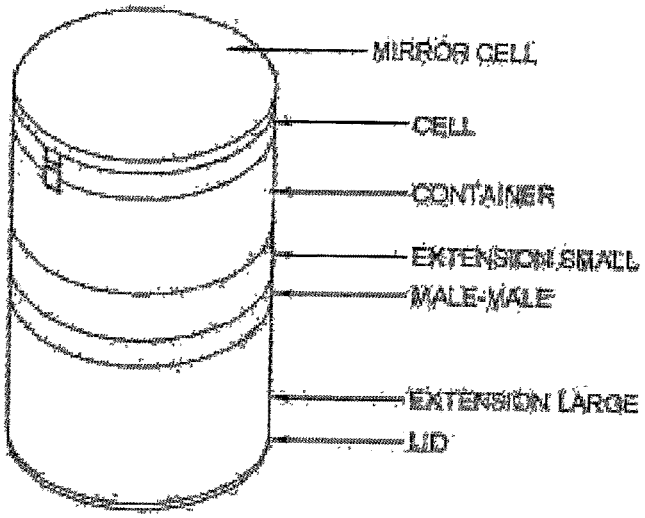
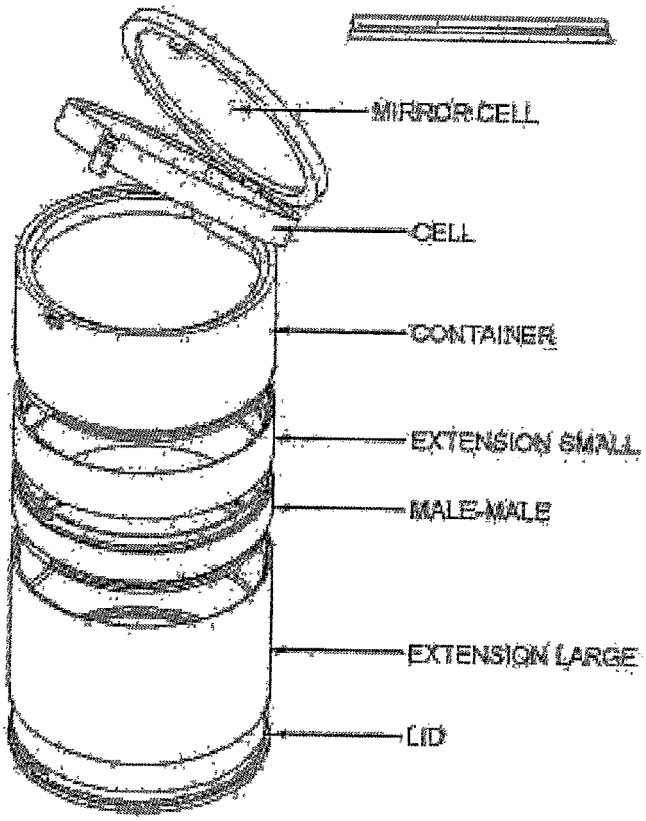
FIG. 47

FIG. 51
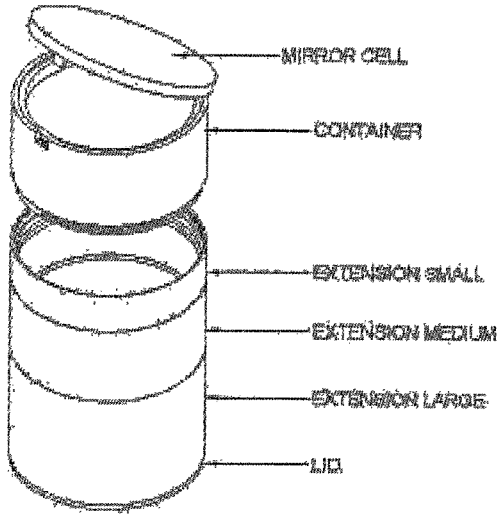
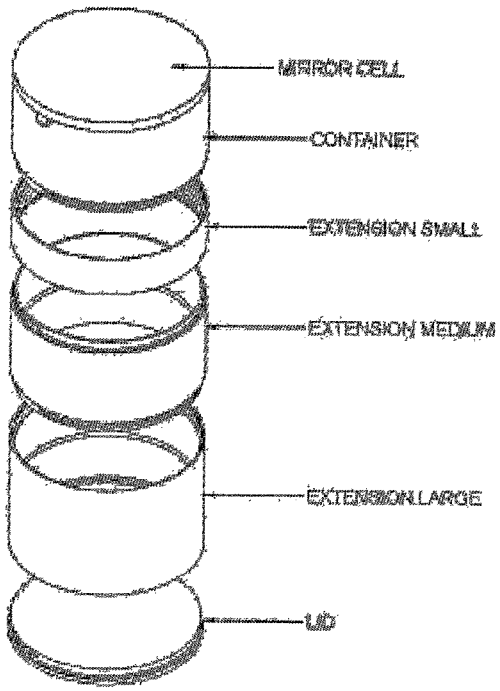
FIG. 50
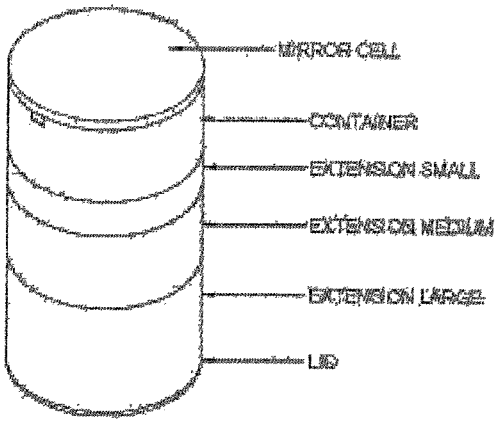
FIG. 52

FIG. 63
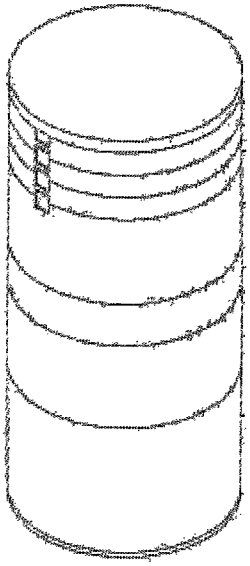
FIG. 63A
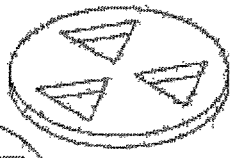
FIG. 63B
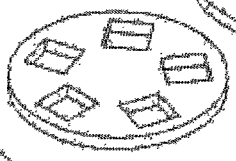
FIG. 63C
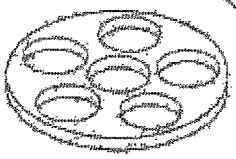
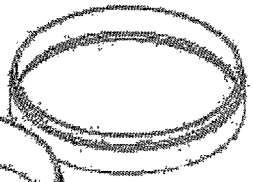
FIG. 63D
(Connector-Male-Female)
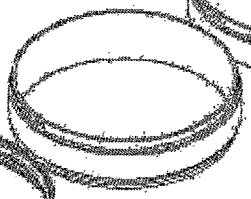
FIG. 63E
(Connector-Male-Male)
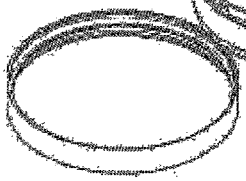
FIG. 63F
(Connector-Female-Female)

FIG. 69
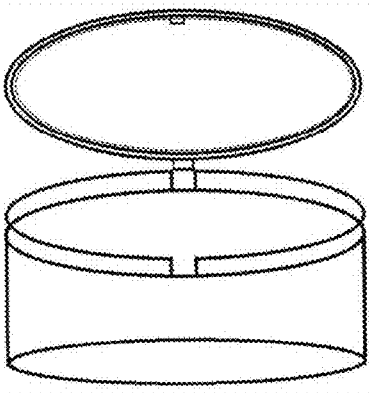
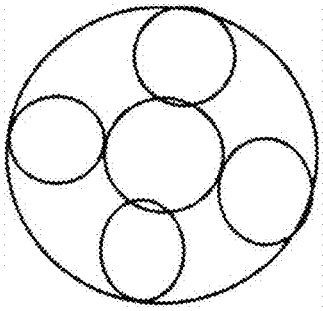
FIG. 70
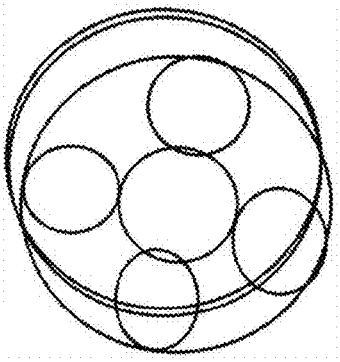
FIG. 71
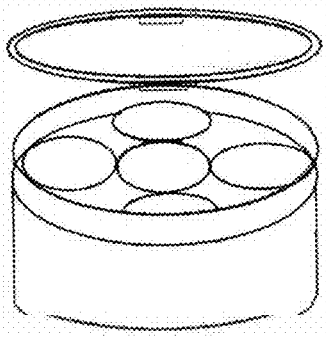
FIG. 72A
(Multiple Compartments and a mirror)
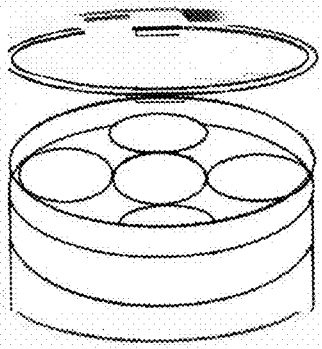
FIG. 72B
(One Compartments with mirror and storage below)

FIG. 73
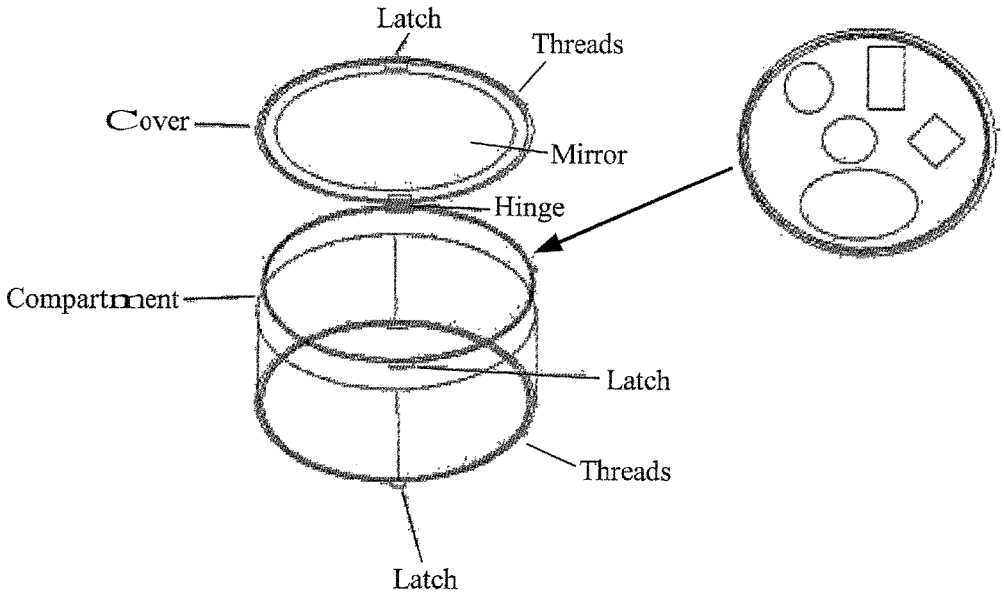
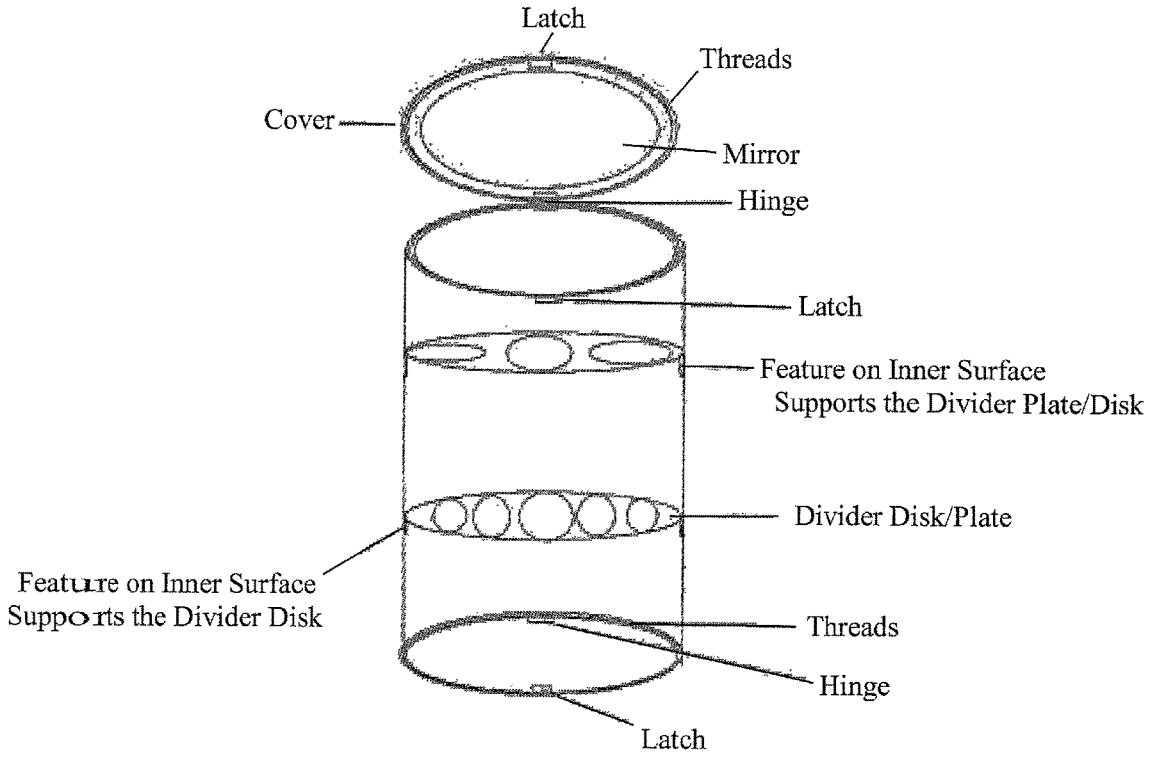
FIG. 74

MODULAR MULTI-LAYER MULTI-COMPARTMENT COSMETICS CONTAINER

CROSS REFERENCES TO RELATED APPLICATIONS

This application is a continuation-in-part of U.S. Patent Application Ser. No. 15/136,903, filed on Apr. 23, 2016, all disclosures of which are incorporated herein by reference.

FIELD OF THE INVENTION

The present invention relates generally to a container for cosmetics and/or personal items, and more particularly to a multi-layer multi-compartment container that is configured to store different types of cosmetics and personal items, which compartments may be "horizontally" or "vertically" oriented.

BACKGROUND OF THE INVENTION

Existing cosmetic and personal item containers have a number of problems. Multi-layered cosmetic and personal containers loosely store a number of items at each layer, which can freely move and in many cases can mix with each other items or can become unorganized very easily. Available multi-layered containers provide mostly flat horizontal containers, where it is difficult to store vertical tall items.

Most multi-layered containers are bulky and cannot be carried around. Multi-compartment cosmetic and personal containers that can be carried around cannot store vertical tall items or they have very limited storage for a limited number of vertical tall items. Many also do not provide the convenience of attaching, detaching, or shuffling multiple similar containers that store different items.

There is a need for a multi-compartment cosmetic and personal item container that can store both vertical and horizontal items at the same time, with the facility to store multiple vertical tall cosmetic items and multiple horizontal flat cosmetic items in a single multi-compartment container. There is also a need for a multi-compartment container that can be compact and can be conveniently carried around in purse or handbags for doing makeup and personal care on the go, with the facility to use different items held in different compartments while on the road or outside. Ability to attach, detach, or shuffle multiple similar compartments that store different items can provide added convenience, which is also needed.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention solves existing problems by providing a multi-layer multi-compartment cosmetic container that may store both vertical and horizontal cosmetic and personal items at the same time, with the facility to store multiple vertical tall items and multiple horizontal flat items in a single multi-compartment container. It is compact and may be conveniently carried around in purse or handbags for doing makeup or personal care on the go. It provides added facility to use different items held in different compartments while on the road or outside. Multiple similar compartments may be attached, detached, or shuffled to form a combined container that may serve any purpose by removing compartments that are not needed and adding compartments that are needed.

Current device solves problem with organization by containing one item each in one compartment, and by separating different items of different sizes in different layers, particularly by facilitating storage of vertical tall items all in one layer, and multiple horizontal flat items in consecutively ordered and stacked horizontal flat container layer. The device helps keep the purse clean and organized by containing different items of different shapes in one container. It also helps in reducing waste of cosmetic items as the interchangeable compartments may be removed and refilled on as needed basis, only refilling the detachable compartment that needs refilling.

The device provides a multi-layer cosmetic and personal item storage container that has multiple compartments in a vertical layer to store vertical or tall cosmetic items that have greater height than width, for example, lipstick, perfume, makeup brush, eye-liner, mascara, lipcolor, lipgloss, nail file, nail cutter, etc. A number of vertical sub-containers are attached together in a single layer compartment to facilitate storing a number of vertical cosmetic and personal items separately but conveniently together in one layer in a space-saving manner. These vertical sub-containers may be permanently constructed together with shared surface wall to provide a rigid and fixed arrangement that will not get separated even if it falls on the ground. On the other hand, these vertical sub-compartments may be constructed as separate containers with their own side walls, which may be attached with each other to form a collective container to store multiple vertical cosmetic items. These attachable and detachable vertical sub-compartments may be reshuffled to ensure only required items are contained in the combined container.

This device also provides multiple horizontal compartment layers that may be attached on the top of the vertical sub-compartment layer, at the bottom of the vertical sub-compartment layer, or in any other combination. These horizontal compartment layers are thin and have greater width or diameter than height, and may store similar horizontal or flat cosmetic and personal items; for example, powder, foundation, cream, eye-shadow, rouge, pins, hair ties, small jewelry, other accessory items, etc. One or more than one horizontal compartments may be attached on the top, or at the bottom of the compartment layer with multiple vertical sub-compartments, facilitating storage of multiple horizontal cosmetic and personal items in separate compartments. These horizontal compartments are also easily interchangeable, replacing one with another similar one. Their numbers and combinations may be arranged in many different ways, with one or more horizontal compartments at the top can be combined with one or more horizontal compartments at the bottom. Alternatively, horizontal compartments from either the top or the bottom can be removed completely, using either compartments only at the bottom or only on the top of the vertical sub-compartments.

Horizontal layer compartments have fastening mechanism at the top peripheral edge and at the bottom peripheral edge. Layer with vertical sub-compartments also have fastening mechanisms at the top and bottom peripheral edge. One example of fastening mechanism can be screw type mechanism with helical ridge on the outer and inner peripheral edges whereby inner circular peripheral edge one layer can be screwed onto outer circular peripheral edge of another layer. Another example of the fastening mechanism can be male type depressed peripheral edge which can be stuck onto female type expanded peripheral edge. Another example could be fastening mechanism with snap on groove on the peripheral edge of one layer and ridge on the peripheral edge of another layer. Either groove or ridge can be on the outer peripheral with the other on the inner peripheral, and thus can be snapped onto each other, fastening two layers of compartments, or may be joined using any other mechanism disclosed hereinafter, including, but not limited to, using magnets.

Each of the layers of the container may have a cross-section shape that may be circular, elliptical, trigonal, rectangular, square, pentagon, hexagon, another polygonal shape, and/or some other regular or irregular geometric shape. All the layers of the container may have the same cross-sectional shape, so that each layer can be easily fastened onto an adjacent layer, or alternatively, different cross-sectional shapes may be used for different layers of the same container, which may be joined together using a special connector that has a different shape at each end. Circular layers can be fastened onto other circular layer with the appropriate type fastening mechanism. Compartments with different cross-sectional shapes may be fastened together using other fastening mechanisms (e.g., the "special connector"), such as, for example, using a male-female snap on, etc. Thin containers with elliptical or rectangular peripheral walls are easier to carry in handbag, and other bags. Narrow containers with circular, square, hexagonal peripheral walls can also be carried in handbag and small bags. On the other hand, thick containers with circular, square, or hexagonal shaped structures can hold enough cosmetic and personal items for any long journey, or for a whole day, or for multiple events.

Different variations of the multi-compartment design can provide additional functionalities to make the compartment even more useful.

In some embodiments, vertical sub-compartments can be covered with spaying mechanism to contain liquid that can be sprayed; for example, perfume, deodorant, etc.

In some embodiments, the layer with vertical sub-compartments can be swollen in the middle to contain more cosmetic material, and at the same time can provide easy grip to hold the compartment while using on the move.

In some embodiments, another variation of the design can include increasingly expanded layers that are attached on top or bottom of the layer with multiple vertical sub-compartments. Such expanded top and bottom with narrow middle layer with multiple vertical sub-compartments provides good grip to hold the middle part of the combined container, and at the same time expanded horizontal layers provide more space to hold horizontal cosmetic items.

In some embodiments, a design variation can have a door on the side of the vertical sub-compartments to access them directly without opening the top cover or top covering horizontal layers, which would involve unfastening the fastening mechanism. Without the door, vertical sub-compartments can be accessed only by opening the top cover or horizontal layers covering the open top.

Open top of the topmost layer, whether it is the vertical layer with multiple vertical sub-compartments or a horizontal container layer, can be covered with a cover with peripheral edge with fastening mechanism.

In some embodiments, top cover of the topmost horizontal container layer can have a mirror on the inside of the cover. This mirror can be used for looking at the face while applying cosmetic in any of the compartment of the container.

In some embodiments, top cover of the topmost horizontal container layer with a mirror on the inside of the cover can be hinged with the top peripheral edge of the container, so that the mirror can be flipped open while applying a separate cosmetic item or a cosmetic item from one of the other layers of the container.

In some embodiments, there can be a mirror at the bottom part of the bottommost horizontal compartment. Additionally, the mirror can hinged with the peripheral edge of the container or the mirror can come off as a detachable part. This mirror can be used while applying cosmetic or make from any compartment of the container.

The multi-layer multi-compartment container with capacity to store both horizontal and vertical cosmetic items can be built with any suitable material that can be used to build cosmetic container, cosmetic box, or other cosmetic device. For example, it can be built with plastic, acrylic, plastic variant, metal, metal hybrid, carbon fiber, glass, wood, or a combination of any of these materials.

In another embodiment, a modular multi-layer multi-compartment container assembly may include one or more cosmetics compartment layers, a lidded compartment layer, and a bottommost compartment layer. The one or more cosmetics compartment layers each include: a bottom wall, a side wall with a first end joined to the bottom wall to form an opening into a cavity; a hinge knuckle disposed proximate to a bottom portion of the side wall, and a hinge pin disposed proximate to a top portion of the side wall. The hinge knuckle has a cylindrical through-hole and a slotted opening, permitting the hinge knuckle of each of two or more of these cosmetics compartment layers to releasably and pivotally couple to the hinge pin of an adjacent compartment layer. The lidded compartment layer also includes a hinge knuckle that permits the lidded compartment layer to releasably and pivotally couple to the hinge pin of an uppermost layer of the one or more cosmetics compartment layers. The bottommost compartment layer includes is formed substantially the same as each the one or more cosmetics compartment layers, but may be formed without a hinge knuckle.

The container assembly may be formed such that the axis of each of the cylindrical through-holes are all parallel, spaced apart, and coplanar.

Each of the one or more cosmetics compartment layers and the lidded compartment layer may include a latch to releasably secure the layer from being inadvertently opened when flipped into a closed position and latched.

Each of the hinge knuckles, as well as the latch features, of the one or more cosmetics compartment layers and the lidded compartment layer may be pivotally mounted to its compartment layer, permitting movement of the knuckles (and latch) into a retracted position, so the compartment can sit flush on a flat surface such as a table top. With the hinge knuckle and latch being so configured, in combination with the releasable hinge knuckle structure/feature, a user of the cosmetic container may at any time to be able to use each compartment layer separately, as if it was created as a single product container, Being so configured, the first one of the two or more cosmetics compartment layers covers the cavity of the adjacent one of the two or more cosmetics compartment layers when pivoted into a closed position; the lidded compartment layer covers the cavity of the uppermost layer of the one or more cosmetics compartment layers when pivoted into a closed position; and the cavity of the bottommost compartment layer is covered by the bottom wall of the bottommost layer of the one or more cosmetics compartment layers when pivoted into a closed position.

In yet another embodiment, a multi-layer multi-compartment container assembly may include a compartment layer having a greater width than height, and/or a cosmetics compartment layers having a greater height than width, and into either of which may be inserted at least one divider member. The divider member is shaped to be received in the interior of the compartment, and includes a plurality of openings configured to create a plurality of sub-compartments, each of which sub-compartments may respectively support a tall cosmetic item therein. Each of the plurality of cosmetics compartment layers may be configured to releasably receive the divider member, which may be snapped into a portion of the compartment's interior, or may be received therein in a friction fit, or using any other suitable releasable connection/coupling known in the art. The plurality of openings in the divider member may all be shaped the same, or there may be two or more different shaped opening, or each of the openings may have a different shape. The shaped openings in the divider member may be usable to support: a tube of lipstick; an eye-liner container; a nail file; a makeup brush; a container of perfume; a stick of eye-shadow; a bottle of nail polish; etc. Note that the insertion of two divider members may provide better support for such items.

BRIEF DESCRIPTION OF THE DRAWINGS

The present disclosure, in accordance with one or more embodiments, is described in detail with reference to the following figures. The drawings are provided for purposes of illustration only and merely depict example embodiments. These drawings are provided to facilitate the reader's understanding of the apparatus and its use and shall not be considered limiting of the breadth, scope, or applicability of the invention. It should be noted that for clarity and ease of illustration these drawings are not necessarily made to scale.

FIG. 26A shows a connector transitioning from being square with a hinge, to a round male end.

FIG. 26B shows a connector transitioning from being square with hinge, to an oval push connection end.

FIG. 26C shows a connector transitioning from being square with hinge, to a threaded female connection end.

FIG. 26D, FIG. 26E, FIG. 26F, FIG. 26G, FIG. 26H, and FIG. 26J are various views showing connectors/compartments each transitioning from being square to round, with various end connection types, including a hinge connection, a friction fit connection, a female threaded connection, and a male threaded connection.

FIG. 28 shows a side view of another embodiment of a container assembly that includes a plurality of compartment layers that are pivotally coupled together using a releasable hinge arrangement as disclosed herein, with all the layers being shown pivoted opened.

FIG. 29 is a perspective view showing the container assembly of FIG. 28, indicating that one of the compartment layers can be removed and/or that another may be added.

FIG. 30 is a perspective view showing only the three smaller compartment layers of the container assembly of FIG. 29, with two compartment layers shown in the closed position, and one compartment layer shown in an open position to expose the hinge.

FIG. 30A is an enlarged detail view of the hinge shown in FIG. 30.

FIG. 31 is the perspective view of FIG. 30, but is shown with the hinge of the opened compartment layer after being decoupled from the adjacent compartment layer.

FIG. 31A is the enlarged detail view of the decoupled hinge of FIG. 31.

FIG. 31B is a side view showing the hinge knuckle of FIG. 31A just prior to being coupled to the pin of the adjacent compartment layer.

FIG. 31BB is a side view showing a different version of a hinge knuckle, being similar to the hinge knuckle of FIG. 31B, but being formed by using an opening that removes less material.

FIG. 31C is the side of FIG. 31B, shown just after the hinge knuckle is coupled to the hinge pin of the adjacent compartment layer.

FIG. 32 is an enlarged detail view of the container assembly of FIG. 29, showing a latch arrangement that may be used to releasably couple any one of the compartment layers to an adjacent compartment, as it pivots into a closed position.

FIG. 32A is a side view showing a shaped protrusion on one of the compartment layers in FIG. 32 just prior to becoming engaged with a shaped recess on the adjacent compartment layer, which shaped protrusion and shaped recess may be used to form the latch.

FIG. 32B shows the two compartment layers of FIG. 32A, but just after the shaped protrusion is releasably engaged with the shaped recess to latch the two compartments together, and releasably inhibit relative motion therebetween.

FIG. 32C shows the two compartment layers of FIG. 32B, and two additional compartment layers being latched thereto, with the uppermost layer being without the shaped recess, and the bottommost layer being without the shaped protrusion.

FIG. 42 is the top perspective view of FIG. 37B, but shown as a transparent view.

FIG. 42A is an enlarged detail view of another embodiment of a hinge arrangement and a detent arrangement for the compartment layer shown in FIG. 37A.

FIG. 43 is the exploded view of FIG. 36, but shown without the large extension section, and which replaces the male-male connector with a male female connector, being usable to form a smaller container assembly.

FIG. 44 is a perspective view of a female-female connector.

FIG. 45 is a perspective view of the male-male connector.

FIG. 47 is an exploded perspective view of component parts that are usable to form another container assembly, and which includes a mirror compartment layer, a small cell/compartment layer, a container layer, a small extension, a male-male connector, a large extension section, and a lid that may be threadably coupled to the large extension.

FIG. 48 is an exploded side view of the components shown in FIG. 47

FIG. 49 shows the components of FIG. 47 after being assembled to form a multi-compartment container assembly.

FIG. 50 is an exploded perspective view of component parts that are usable to form yet another container assembly, and which includes a mirror cell/compartment layer, a container layer, a small extension, a medium extension, a large extension section, and a lid.

FIG. 51 is an exploded perspective view of the component parts of FIG. 50, in which several of the parts are assembled together.

FIG. 52 shows the components of FIG. 50 after being assembled to form a multi-compartment container assembly.

FIG. 63 is a perspective view of a container assembly, as seen in FIGS. 33-34, and which may receive a divider member therein.

FIG. 63A shows another divider member with different shaped openings that can be used in a container assembly, such as the one shown in FIG. 63.

FIG. 63B shows yet another divider member with different shaped openings that can be used in a container assembly, such as the one shown in FIG. 63.

FIG. 63C shows a different divider member with different shaped openings that can be used in a container assembly, such as the one shown in FIG. 63.

FIG. 63D shows a male-female connector that may be used with a container assembly, such as the one shown in FIG. 63.

FIG. 63E shows a male-male connector that may be used with a container assembly, such as the one shown in FIG. 63.

FIG. 63F shows a female-female connector that may be used with a container assembly, such as the one shown in FIG. 63.

FIG. 69 shows another container assembly that is formed of a pivotal cover and a container section and a connector section, and which has a larger space underneath that may be used as storage for items that may be need on a daily basis, such as safety pins, hair ties, small chains, rings, etc.

FIG. 70 shows a divider member that may be received within one of the sections of the container assembly of FIG. 69.

FIG. 71 shows the connector section of the container assembly of FIG. 69, after having received the divider member of FIG. 70.

FIG. 72A shows another container assembly, with the divider member of FIG. 70 installed into one of its sections, and which includes an additional connector to provide additional space so that larger items or more items can be stored therein at one time, and where a plurality of such connectors may be added at the same location or a different location between the various compartment layers of the container.

FIG. 72B shows the container assembly of FIG. 69, but which also has the divider member of FIG. 70 installed in the connector section.

FIG. 73 is an exploded view showing a container assembly that includes a container section and a pivotal cover, into which may be received a divider member that includes a plurality of different shaped openings, and which illustrates both hinges and threading on the same part to show that either type of fastening mechanism can be used, though not necessarily at the same time within the same part.

FIG. 74 shows yet another container assembly that includes a container section and a pivotal cover, into which has been received a first divider member and a second divider member and which illustrates both hinges and threading to show that either type of fastening mechanism can be used, though not necessarily at the same time within the same part.

FIG. 75 is an exploded view showing a first container and a second container, which may be releasably coupled together, and also showing respective covers.

FIG. 76 shows the first container and second container of FIG. 75, but shown after being releasably coupled together.

FIG. 77 shows a container assembly that includes a sealed container section coupled to a vertical compartment layer which contains two divider members, and which also shows two different types of covers.

FIG. 78 shows the sealed container section positioned over a stack of horizontal and vertical compartments.

FIG. 79 shows two sealed containers sections respectively located on the top and the bottom of a vertical compartment.

FIG. 80 shows the sealed container used in combination with a mirror compartment layer and another cosmetic compartment layer.

FIG. 81 is an enlarged view of the sealed container section of FIG. 77.

DETAILED DESCRIPTION OF THE INVENTION

Figure 1:
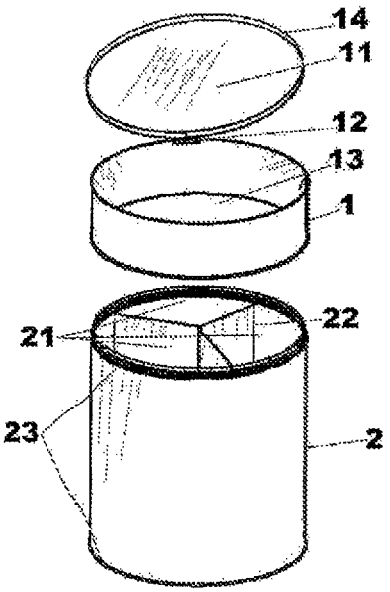
FIG. 1 is an exploded perspective view of an embodiment with a layer with three vertical sub-compartments that is covered on the top by a horizontal compartment layer, wherein all layers have circular perimeter.

As used throughout this specification, the word "may" is used in a permissive sense (i.e., meaning having the potential to, or being optional), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, It is noted that the citing of any reference within this disclosure, i.e., any patents, published patent applications, and non-patent literature, is not an admission regarding a determination as to its availability as prior art with respect to the herein disclosed and claimed apparatus/method.

Furthermore, any reference made throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with design variations described in the specification, as well as applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole/recess) is smaller than the part received therein (e.g., a shaft/protrusion), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: en.wikipedia.org/wiki/Engineering_fit; and "Three General Types of Fit," available at mmto.org/~dclark/Reports/Encoder%20Upgrade/fittolerences%20%5BRead-Only%5D.pdf.

It is further noted that any use herein of relative terms such as "top," or "topmost" or "bottom," or "bottommost," or "upper," or "uppermost," or "lower," or "lowermost," or "vertical," and/or "horizontal" are merely intended to be descriptive for the reader, and may be based on the depiction of those features within the figures for one particular position of the container assembly (e.g., when folded into closed positions and siting on a table top). As such, use of these terms is not intended to limit the orientation with which the disclosed container assembly may be utilized.

The embodiments described herein are exemplary. Descriptions in terms of these embodiments is provided to allow various features to be portrayed in the context of an exemplary application. As will be clear to one of ordinary skill in the art, the invention can be implemented in different and alternative embodiments without departing from the spirit or scope of the invention.

In disclosed device, multiple vertical sub-compartments are all combined together in one compartment layer 2. The sub-compartments are separated by vertical surface walls 22. A cover or a horizontal compartment layer 1 can cover the top openings 21 of plurality of sub-compartments of the vertical layer 2. Another horizontal compartment layer 3 can be attached to the bottom of the vertical layer 2. More than one horizontal compartment layers can also be attached on top of the vertical layer 2 by adding other horizontal compartment layers 1*a*, 1*b*, 1*c*, etc. in addition to one horizontal compartment layer 1. In the same way, more than one horizontal compartment layers can be attached to the bottom of the vertical layer 2 by adding other horizontal compartment layers 3*a*, 3*b*, 3*c*, etc. in addition to one horizontal compartment layer 3.

Multiple vertical sub-compartments 2*a*, 2*b*, etc. can be attached to each other using extended embossed projection 28 and corresponding depressed surface 29 on vertical surface walls 22. Multiple horizontal compartment layers 1, 1*a*, 1*b*, etc. can be stacked on top of vertical layer 2 by attaching on top of each other. For example, 1*b* can be attached on top of 2 covering top openings 21, 1*a* can be attached on top of 1*b* covering top opening 13*b*, and 1 can be attached on top of 1*a* covering top opening 13*a*. Similarly, multiple horizontal compartment layers 2, 2*a*, 2*b*, etc. can be stacked at the bottom of vertical layer 2 by attaching on top of each other. For example, 3*b* can be attached at the bottom of 2, 3*a* can be attached at the bottom of 3*b*, and 3 can be attached at the bottom of 3*a*.

Compartment layer 2 with multiple vertical sub-compartments have fastening mechanism at the top peripheral edge 23 and the bottom peripheral edge 23 of the layer 2. Top horizontal compartment layer 1 has fastening mechanism at the bottom peripheral edge 15, which is attached to the fastening mechanism at the top peripheral edge 23 of the vertical layer 2. Bottom horizontal compartment layer 3 has fastening mechanism at the top peripheral edge 35, which is attached to the fastening mechanism at the bottom peripheral edge 23 of the vertical layer 2.

When using multiple horizontal compartment layers 1*a*, 1*b*, etc. on top of the vertical layer 2, fastening mechanism 15*a*, 15*b*, etc. at their bottom peripheral edge gets attached to the fastening mechanism at the top peripheral edge of the lower layer. When using multiple horizontal compartment layers 3*a*, 3*b*, etc. at the bottom of the vertical layer 2, fastening mechanism 35*a*, 35*b*, etc. at their top peripheral edge gets attached to the fastening mechanism at the bottom peripheral edge of the upper layer. For example, fastening mechanism at the top peripheral edge 35*b* of the horizontal compartment layer 3*b* gets attached to the fastening mechanism at the bottom peripheral edge 23 of the vertical layer 2; fastening mechanism at the top peripheral edge 35*a* of the horizontal compartment layer 3*a* gets attached to the fastening mechanism at the bottom peripheral edge 33*b* of the horizontal compartment layer 3*b*; fastening mechanism at the top peripheral edge 35 of the horizontal compartment layer 3 gets attached to the fastening mechanism at the bottom peripheral edge 33*b* of the horizontal compartment layer 3*b*.

Topmost horizontal compartment layer 1 can be covered with a cover 14. The cover 14 can be attached to the top peripheral edge of 1 with fastening mechanism. 14 can also be connected to 1 with a hinge 12, so that 14 can be flipped open to uncover the container cavity of 1. There can be a mirror 11 on the bottom inside of the cover 14 for use when applying cosmetic or toiletry item.

Bottommost horizontal compartment layer 3 can also have a mirror 31 attached to the inside of the bottom cover 34, which can be attached with fastening mechanism at the top peripheral edge of 34 and fastening mechanism at the bottom peripheral edge of 3. Bottom cover 34 along with the mirror 31 can also be connected with a hinge 32, so that the mirror 31 can be flipped open for use when applying cosmetic or toiletry items.

Figure 2:
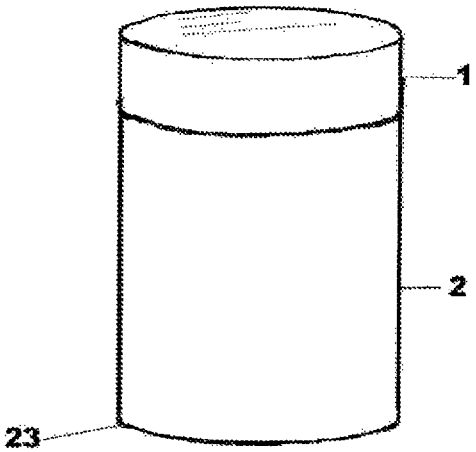
FIG. 2 is an assembled perspective view of the embodiment in FIG. 1.

FIGS. 1 and 2 show the device according to one example of the invention. The device has at least one layer with a single horizontal compartment that can be stuck onto the top or the bottom of multiple vertical sub-compartment layer 2. In this example embodiment, one layer with one horizontal compartment 1 is stuck on top of the vertical sub-compartment 2, which has multiple vertical sub-compartments with top opening 21 and with separating common boundary walls 22. In this example embodiment there are three sub-compartments, but there can be any plural number of vertical sub-compartments, with the only limitation being the number of vertical sub-compartments has to be more than one. The sub-compartments are vertical or tall with height greater than width or diameter. Vertical or tall shape enables storing vertical or tall cosmetic or toiletry items.

Figure 3:
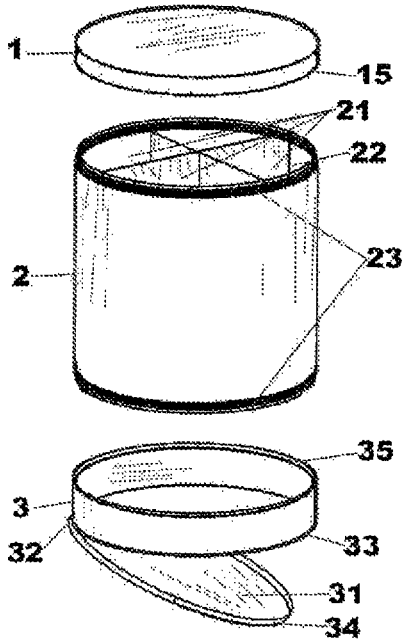
FIG. 3 is an exploded perspective view of an embodiment with a layer with four vertical sub-compartments that is covered on the top by a cover, and a horizontal compartment layer is stuck to the bottom of the vertical layer, wherein all layers have circular perimeter.
Figure 4:
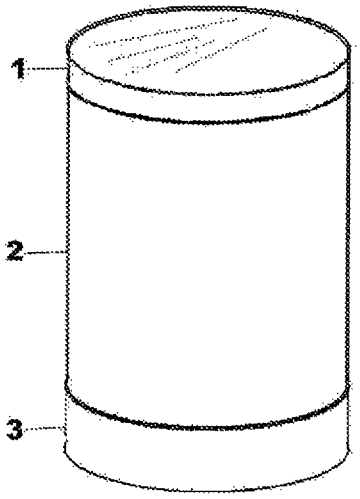
FIG. 4 is an assembled perspective view of the embodiment in FIG. 3.

FIGS. 3 and 4 show another example of the device. Similar to the example embodiment of FIGS. 1 and 2, this example embodiment has only one horizontal compartment 3, which is stuck or fastened at the bottom of the compartment layer 2 with multiple vertical sub-compartments. Since the top openings 21 of the vertical compartment layer 2 is not covered by a horizontal compartment layer, a cover 1 is used to cover the top openings 21. Outside peripheral edges 23 at the top and the bottom of 2 have screw like helical ridges. Bottom inside peripheral edge 15 of top cover 1 and top inside peripheral edge 35 of the bottom horizontal compartment layer have similar screw like helical ridges. Since all these layers are circular in shape in this example embodiment, they can be attached and fastened together like screws using the complimenting helical ridges.

Figure 5:
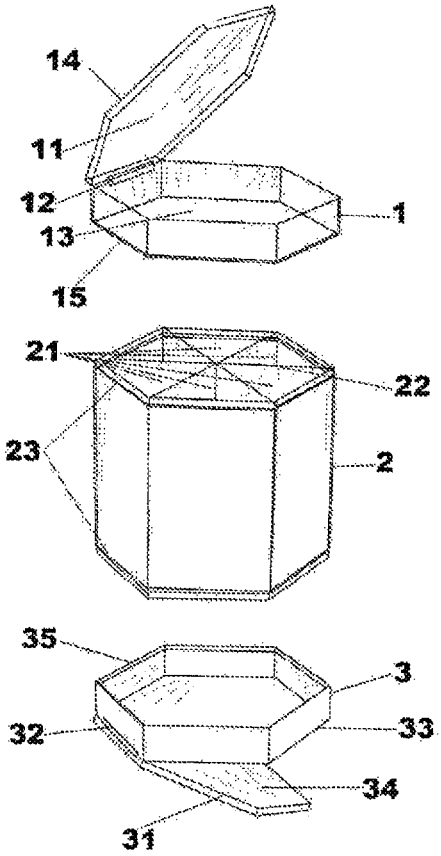
FIG. 5 is an exploded perspective view of an embodiment with a layer with six vertical sub-compartments that is covered on the top by a horizontal compartment layer, and another horizontal compartment layer is stuck at the bottom of the vertical layer, wherein all layers have hexagonal perimeter.
Figure 6:
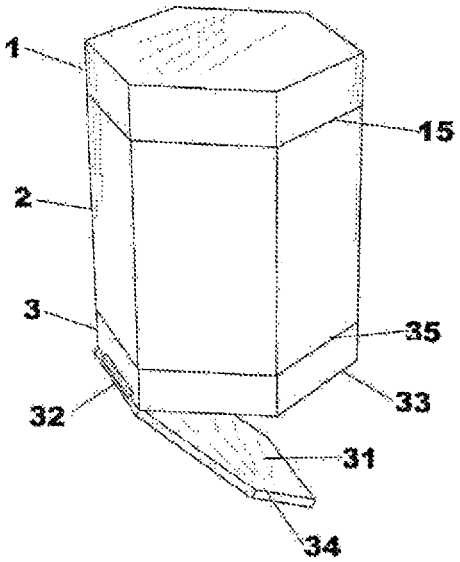
FIG. 6 is an assembled perspective view of the embodiment in FIG. 5.

FIGS. 5 and 6 show an example of the device with hexagonal perimeter shape. It has six triangle shaped vertical sub-compartments at the vertical layer compartment 2. Two horizontal layers 1 and 3 with one horizontal compartment each are attached onto the top and the bottom of 2. Since all these layers have hexagonal perimeter, they cannot be attached with each other using screw like fastening mechanism. Therefore, male type depressed peripheral edge 23 is used as fastening mechanism at the top and the bottom peripheral edge of 2. Bottom peripheral edge 15 of the top horizontal compartment layer 1 and top peripheral edge 35 of the bottom horizontal compartment layer 3 have female type expanded peripheral edge, which can be stuck on top of male type depressed peripheral edge 21.

FIGS. 9, 12, 18, and 21 show how vertical sub-compartment of some embodiments can be attached to each other and detached from each other. For example, two vertical sub-compartments 2*a* and 2*b* can be attached to each other using extended embossed projection 28 and corresponding depressed surface 29 on vertical surface walls 22. This makes vertical sub-compartments 2*a* and 2*b* interchangeable with any similar vertical sub-compartments. They can be replaced when the cosmetic contained in them runs out, with a similar one that has already been filled up.

Figure 7:
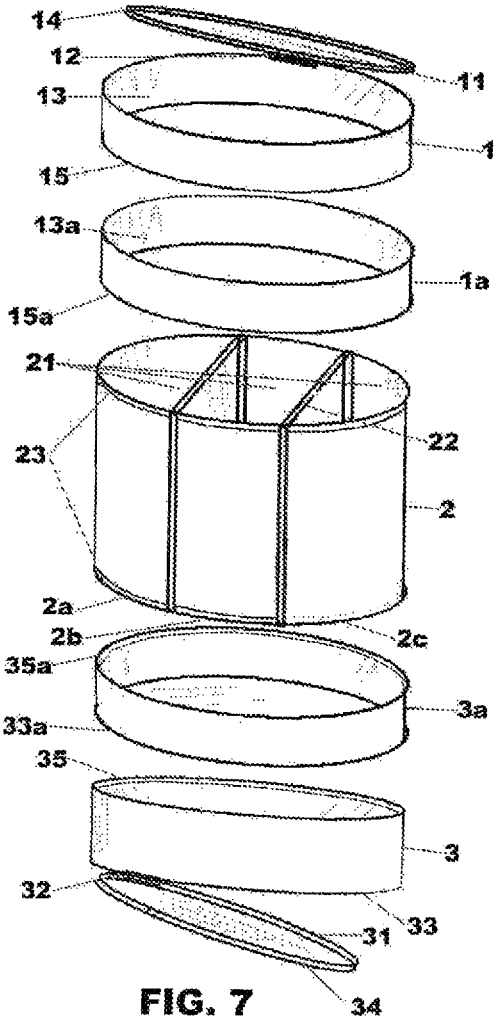
FIG. 7 is an exploded perspective view of an embodiment with a layer with three vertical sub-compartments that is covered on the top by two consecutive horizontal compartment layers stuck on top of each other, and two other consecutive horizontal compartment layers that that are stuck on top of each other are stuck at the bottom of the vertical layer, wherein all layers have elliptical perimeter.
Figure 8:
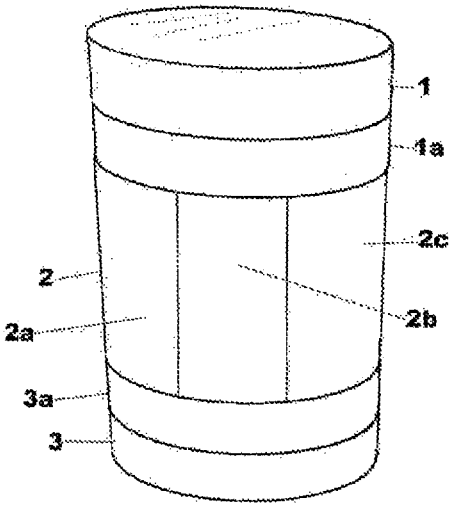
FIG. 8 is an assembled perspective view of the embodiment in FIG. 7.
Figure 9:
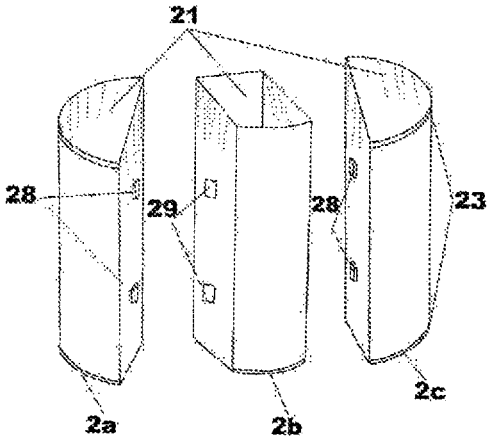
FIG. 9 is an exploded perspective view of the three vertical sub-compartments of the middle layer of the embodiment in FIGS. 7 and 8.

FIGS. 7, 8 and 9 show one example embodiment with elliptical shape, with two top horizontal compartment layers 1 and 1*a*, and two bottom horizontal compartment layers 3 and 3*a*. 1 and 3 both have top cover 14 and 34 with mirrors 11 and 31. 1 and 3 are interchangeable, and can also be exchanged with another similar elliptical horizontal compartment layer with cover. This helps shuffling a number of horizontal layer compartments containing multiple vertical cosmetic item, using only the ones that are needed or useful.

Figure 10:
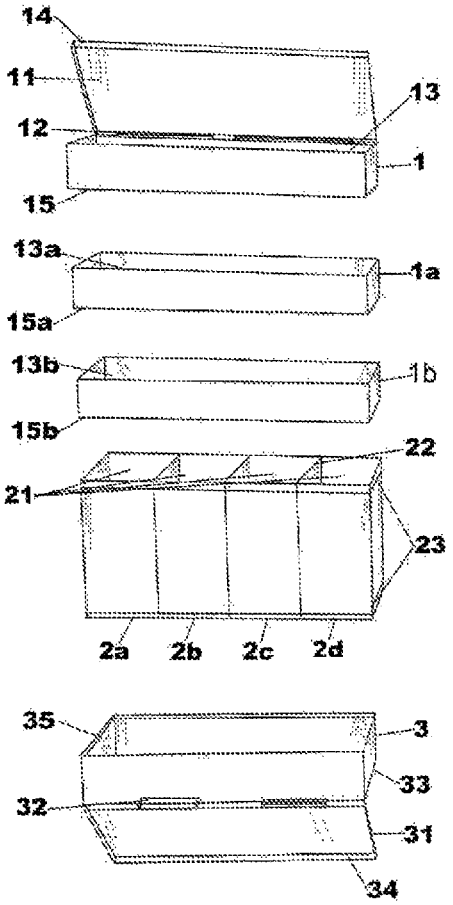
FIG. 10 is an exploded perspective view of an embodiment with a layer with four vertical sub-compartments that is covered on the top by three consecutive horizontal compartment layers stuck on top of each other, and another horizontal compartment layer is stuck at the bottom of the vertical layer, wherein all layers have long rectangular perimeter.
Figure 11:
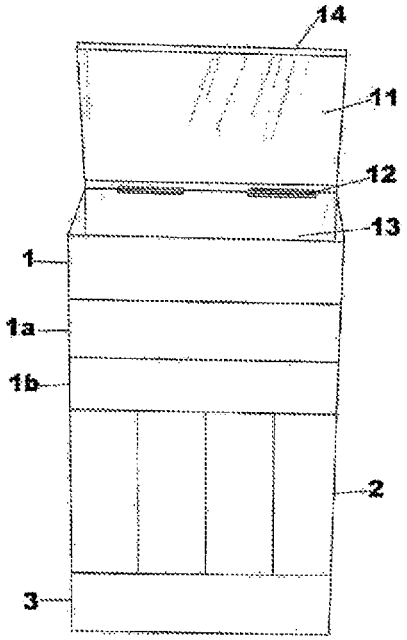
FIG. 11 is an assembled perspective view of the embodiment in FIG. 10.
Figure 12:
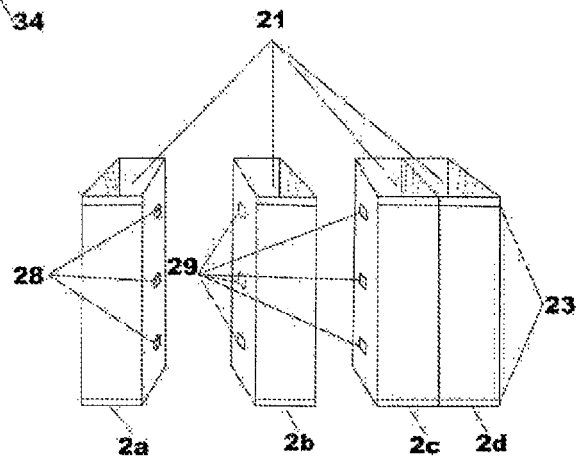
FIG. 12 is an exploded perspective view of the four vertical sub-compartments of the middle layer of the embodiment in FIGS. 10 and 11.

FIGS. 10, 11, and 12 show one example embodiment with rectangular shape, with a number of horizontal compartment layers 1*a*, 1*b*, 1, and 3. 1*a* and 1*b* are interchangeable and can also be interchanged with similar attachable and detachable layers with horizontal compartments. Rectangular shape makes the combined container thin and easy to carry in a purse or handbag. Rectangular shape also makes the shape of all the vertical sub-compartments that same, and therefore making these attachable and detachable sub-compartments easy to interchange or shuffle.

Figure 13:
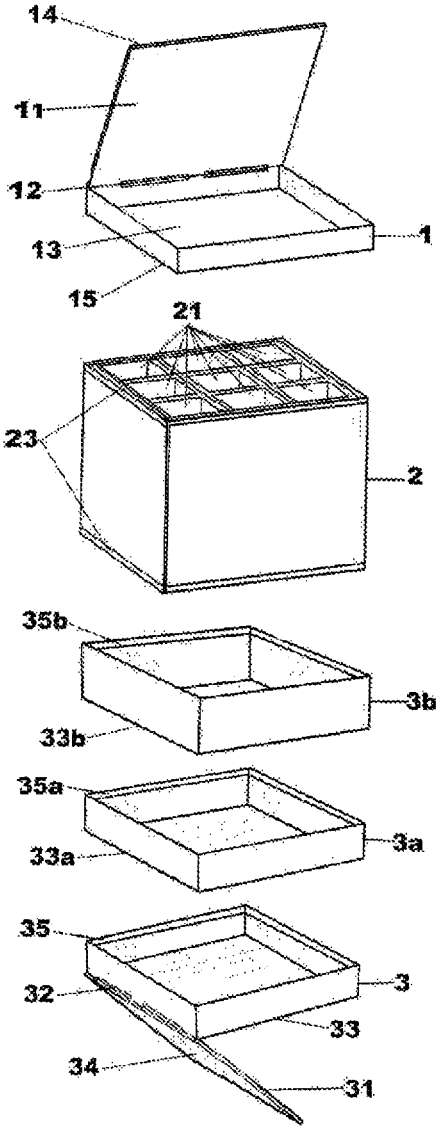
FIG. 13 is an exploded perspective view of an embodiment with a layer with nine vertical sub-compartments that is covered on the top by a horizontal compartment layer, and three other consecutive horizontal compartment layers that that are stuck on top of each other are stuck at the bottom of the vertical layer, wherein all layers have square perimeter.
Figure 14:
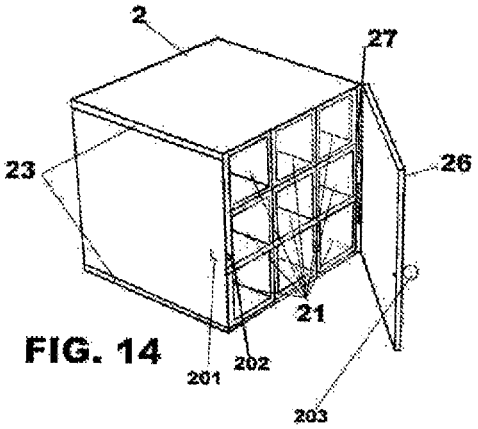
FIG. 14 is a perspective view of the alternate middle layer of the embodiment in FIG. 13, with a side door and all nine vertical tall sub-compartments rotated 90 degree clock-wise toward the side with the door to have their top openings accessible from the side upon opening of the side door.
Figure 15:
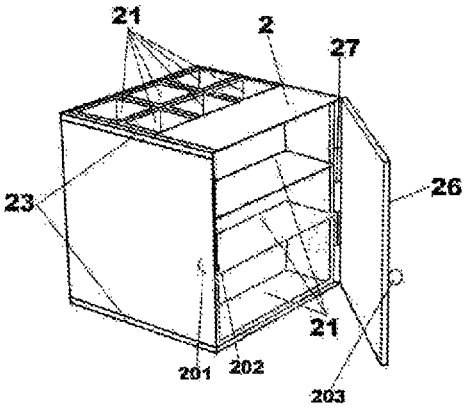
FIG. 15 is a perspective view of the alternate middle layer of the embodiment in FIG. 13, with a side door and only three vertical tall sub-compartments, that are next to the door, rotated 90 degree around the surfaces, that are perpendicular to the door, to have their top openings closed by one of the surface wall while opening up the side of the three vertical sub-compartments to have them accessible upon opening of the side door.

FIG. 13 show one example device with square shape. It has nine vertical sub-compartments at the vertical layer 2. Large number of sub-compartments leave the vertical layer with very narrow and tall vertical sub-compartments, which are very suitable to store very narrow and tall cosmetic and toiletry items like, lipstick, eye shadow, lip liner, nail polish, etc. FIGS. 14 and 15 show different arrangement of the vertical sub-compartments with a side door 26 for easy access. 203, 202, and 201 are door handle, door handle groove, and latch.

Figure 16:
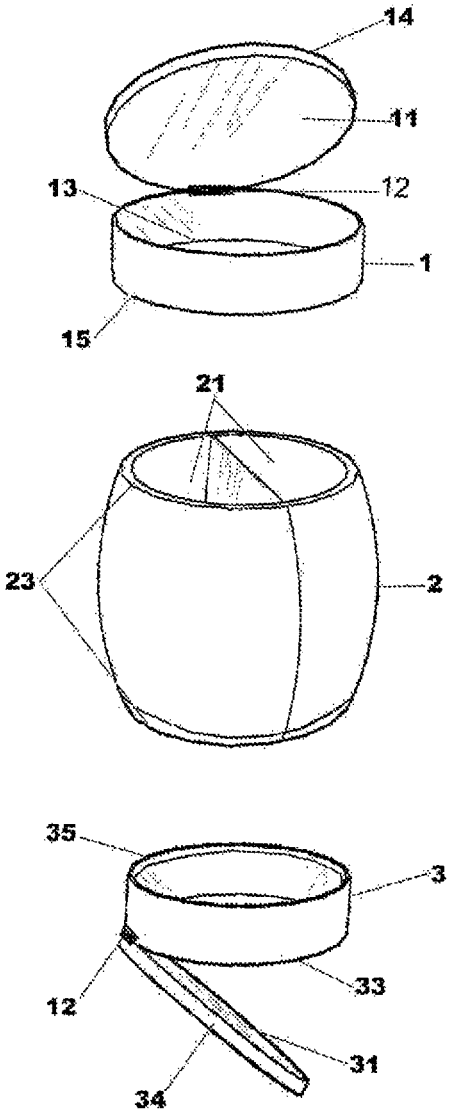
FIG. 16 is an exploded perspective view of an embodiment with a layer with gradually swollen middle and two vertical sub-compartments that is covered on the top by a horizontal compartment layer, and a horizontal compartment layer that is stuck to the bottom of the vertical layer, wherein all layers have circular perimeter.
Figure 17:
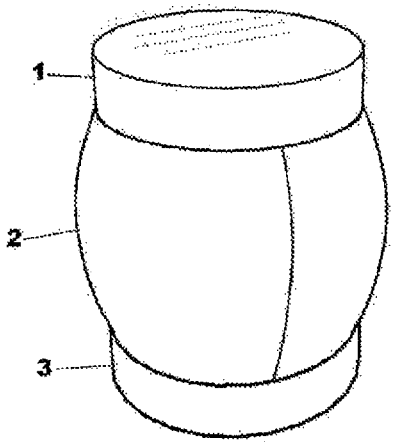
FIG. 17 is an assembled perspective view of the embodiment in FIG. 16.
Figure 18:
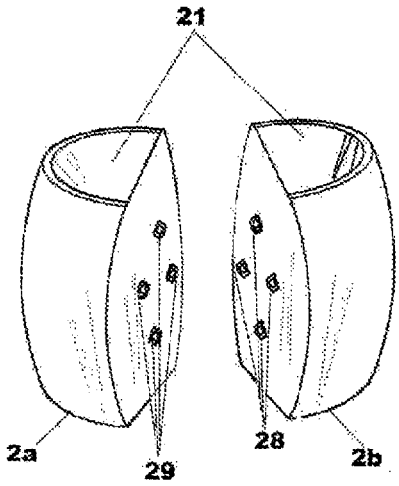
FIG. 18 is an exploded perspective view of the two vertical sub-compartments of the middle layer of the embodiment in FIGS. 16 and 17.

FIGS. 16, 17, and 18 show one example embodiment with circular shape and gradually swelled middle layer 2. Gradually swelled middle layer 2 helps to store more vertical tall cosmetic material.

Figure 19:
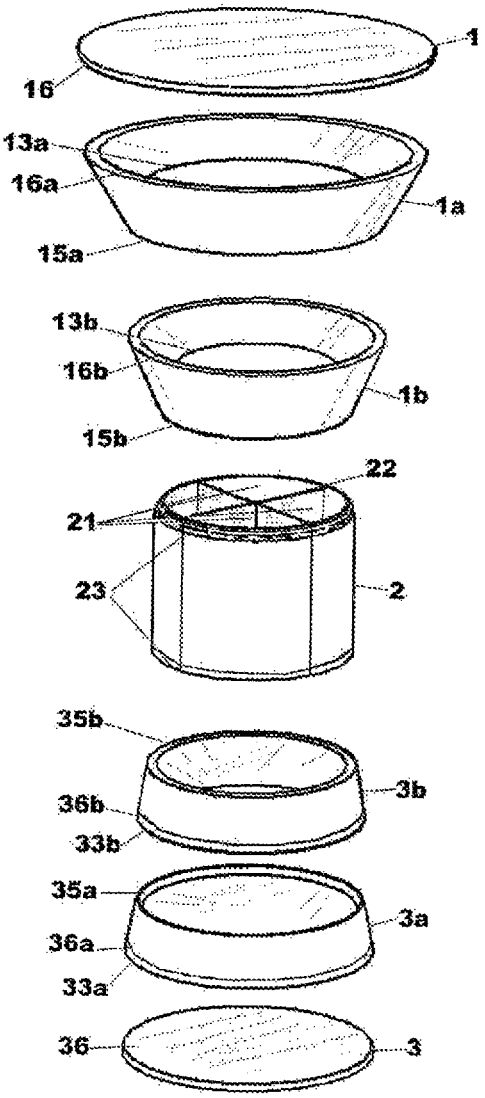
FIG. 19 is an exploded perspective view of an embodiment with a layer with four vertical sub-compartments that is covered on the top by two consecutive horizontal compartment layers stuck on top of each other with their perimeter gradually growing towards the top, and two other consecutive horizontal compartment layers that are stuck on top of each other with their perimeter gradually growing towards the bottom is stuck at the bottom of the vertical layer, wherein all layers have circular perimeter.
Figure 20:
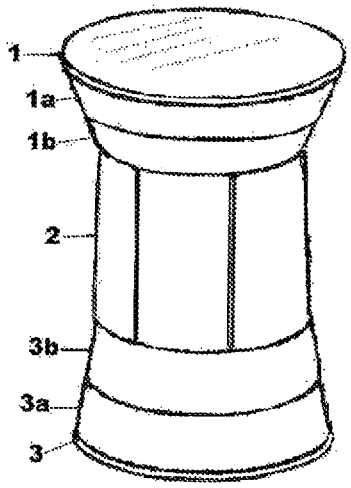
FIG. 20 is an assembled perspective view of the embodiment in FIG. 19.
Figure 21:
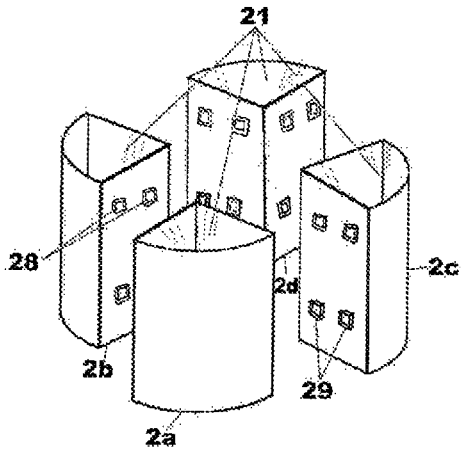
FIG. 21 is an exploded perspective view of the four vertical sub-compartments of the middle layer of the embodiment in FIGS. 19 and 20.

FIGS. 19, 20, and 21 show another example embodiment With circular perimeter shape. It has four vertical sub-compartments 2*a*, 2*b*, 2*c*, and 2*d* that are covered on the top by two consecutive horizontal compartment layers 1*a* and 1*b* stuck on top of each other with their perimeter gradually growing towards the top, and two other consecutive horizontal compartment layers 3*a* and 3*b* that are stuck on top of each other with their perimeter gradually growing towards the bottom is stuck at the bottom of the vertical layer. Top of 1*a* is covered with cover 1, and bottom of 3*a* is covered with cover 3. 1 and 3 are interchangeable. 1*a* and 3*a* are also interchangeable.

Figure 22:
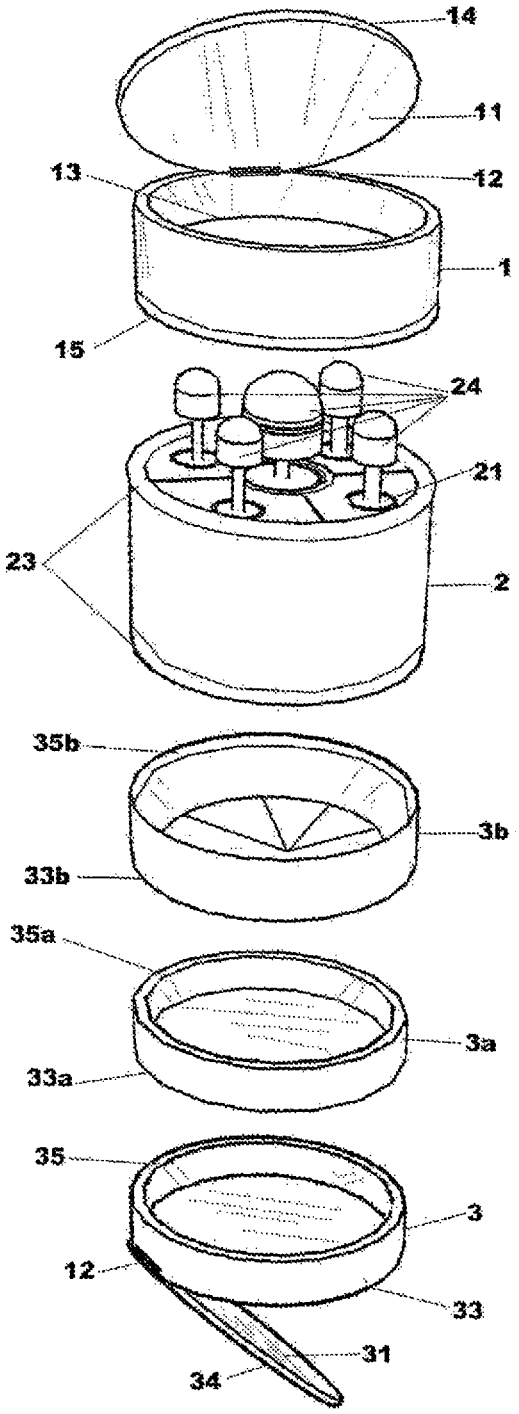
FIG. 22 is an exploded perspective view of an embodiment with a layer with five vertical sub-compartments that is covered on the top by a horizontal compartment layer, and three other consecutive horizontal compartment layers that that are stuck on top of each other are stuck at the bottom of the vertical layer, wherein all layers have square perimeter.

FIG. 22 shows another example embodiment with circular perimeter shape and five vertical sub-compartments forming one vertical layer compartment unit. Top opening of the vertical sub-compartments are covered with nozzle head 24 forming receptacles of liquids in the empty cavity of that vertical sub-compartments, whereby the liquid contained in the receptacle can be sprayed using the nozzle. Perfume, deodorant, etc. liquids that are usually applied by spraying can be stored in these vertical sub-compartments.

Figure 23:
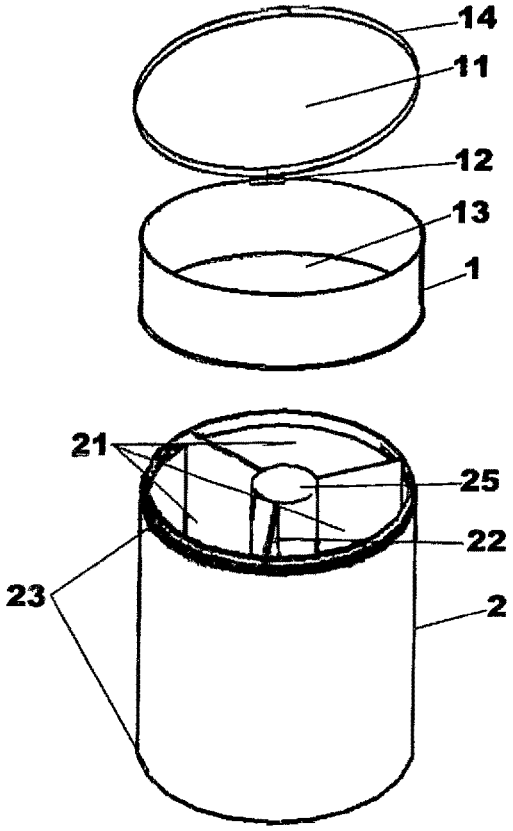
FIG. 23 is an exploded perspective view of an embodiment with a layer with four vertical sub-compartments with one circular sub-compartment at the center that is surrounded by three other sub-compartments around the perimeter, and this layer is covered on the top by a horizontal compartment layer, wherein all layers have circular perimeter.
Figure 24:
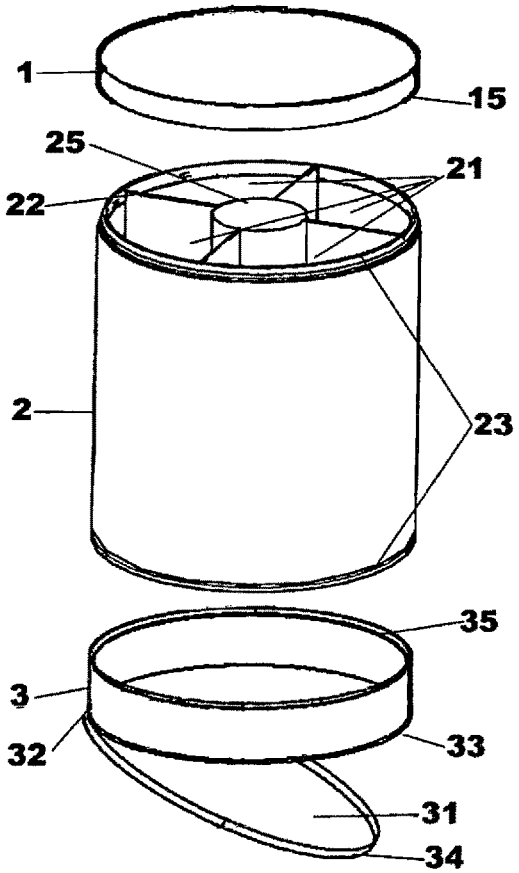
FIG. 24 is an exploded perspective view of an embodiment with a layer with five vertical sub-compartments with one circular sub-compartment at the center surrounded by four other sub-compartments around the perimeter, and this layer is covered on the top by a cover, and a horizontal compartment layer is stuck to the bottom of the vertical layer, wherein all layers have circular perimeter.
Figure 25A:
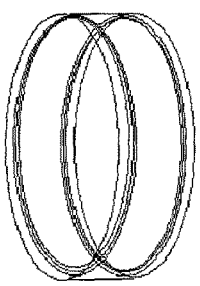
FIG. 25A shows a female-female connector usable in forming a cosmetics container assembly as disclosed herein.
Figure 25B:
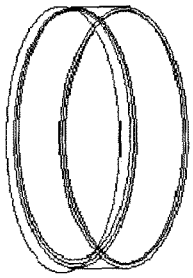
FIG. 25B shows a female-male connector usable in forming a cosmetics container assembly as disclosed herein.
Figure 25C:
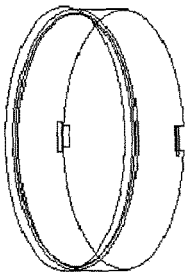
FIG. 25C shows a female-hinge connector usable in forming a cosmetics container assembly as disclosed herein.
Figure 25D:
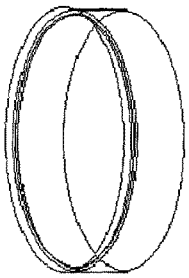
FIG. 25D shows a female-push (e.g., female-friction fit or female-snap-on) connector usable in forming a cosmetics container assembly as disclosed herein.
Figure 25E:
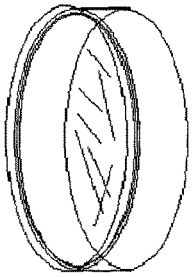
FIG. 25E shows a cover with female threading usable in forming a cosmetics container assembly as disclosed herein.
Figure 25F:
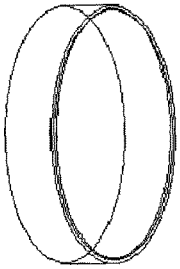
FIG. 25F shows a push-male connector usable in forming a cosmetics container assembly as disclosed herein.
Figure 25G:
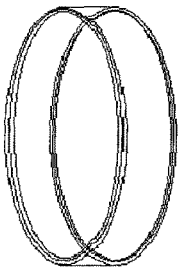
FIG. 25G shows a male-male connector usable in forming a cosmetics container assembly as disclosed herein.
Figure 25H:
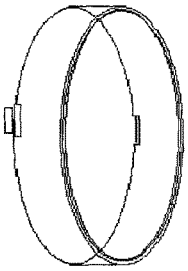
FIG. 25H shows a hinge-male connector usable in forming a cosmetics container assembly as disclosed herein.
Figure 25J:
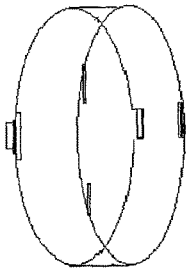
FIG. 25J shows a hinge-twist connector usable in forming a cosmetics container assembly as disclosed herein.
Figure 25K:
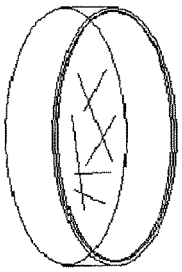
FIG. 25K shows a cover with male threading usable in forming a cosmetics container assembly as disclosed herein.
Figure 25L:
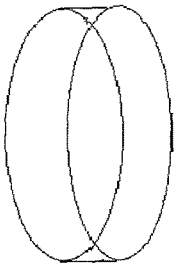
FIG. 25L shows a push-push connector usable in funning a cosmetics container assembly as disclosed herein.
Figure 25M:
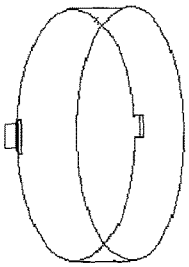
FIG. 25M shows a hinge-push connector usable in forming a cosmetics container assembly as disclosed herein.
Figure 25N:
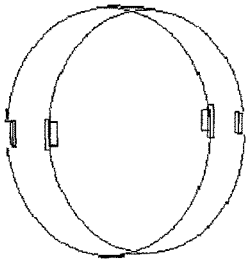
FIG. 25N shows a hinge-hinge connector usable in forming a cosmetics container assembly as disclosed herein.
Figure 25P:
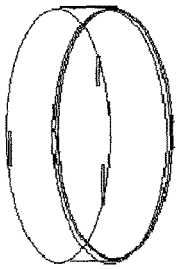
FIG. 25P shows a twist-male connector usable in forming a cosmetics container assembly as disclosed herein.
Figure 25Q:
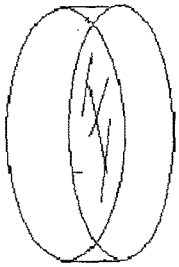
FIG. 25Q shows a cover with an open end that is usable in a friction fit in forming a cosmetics container assembly as disclosed herein.

FIGS. 23 and 24 show example embodiments where a circular vertical sub-compartment at the center of vertical compartment layer helps to effectively utilize the space in the vertical layer. Efficient usage of the space helps in storing more vertical items.

FIGS. 25A through 25M show a series of other connector section that may be used, which may respectively utilize: a female-female connector arrangement; a female-male connector arrangement; a female-hinge connector arrangement; a female-push connector arrangement; a push-male connector arrangement; a male-male connector arrangement; a hinge-male connector arrangement; a hinge-twist connector arrangement; a push-push connector arrangement; a hinge-push connector arrangement; a hinge-hinge connector arrangement; and a twist-male connector arrangement.

Figure 27:
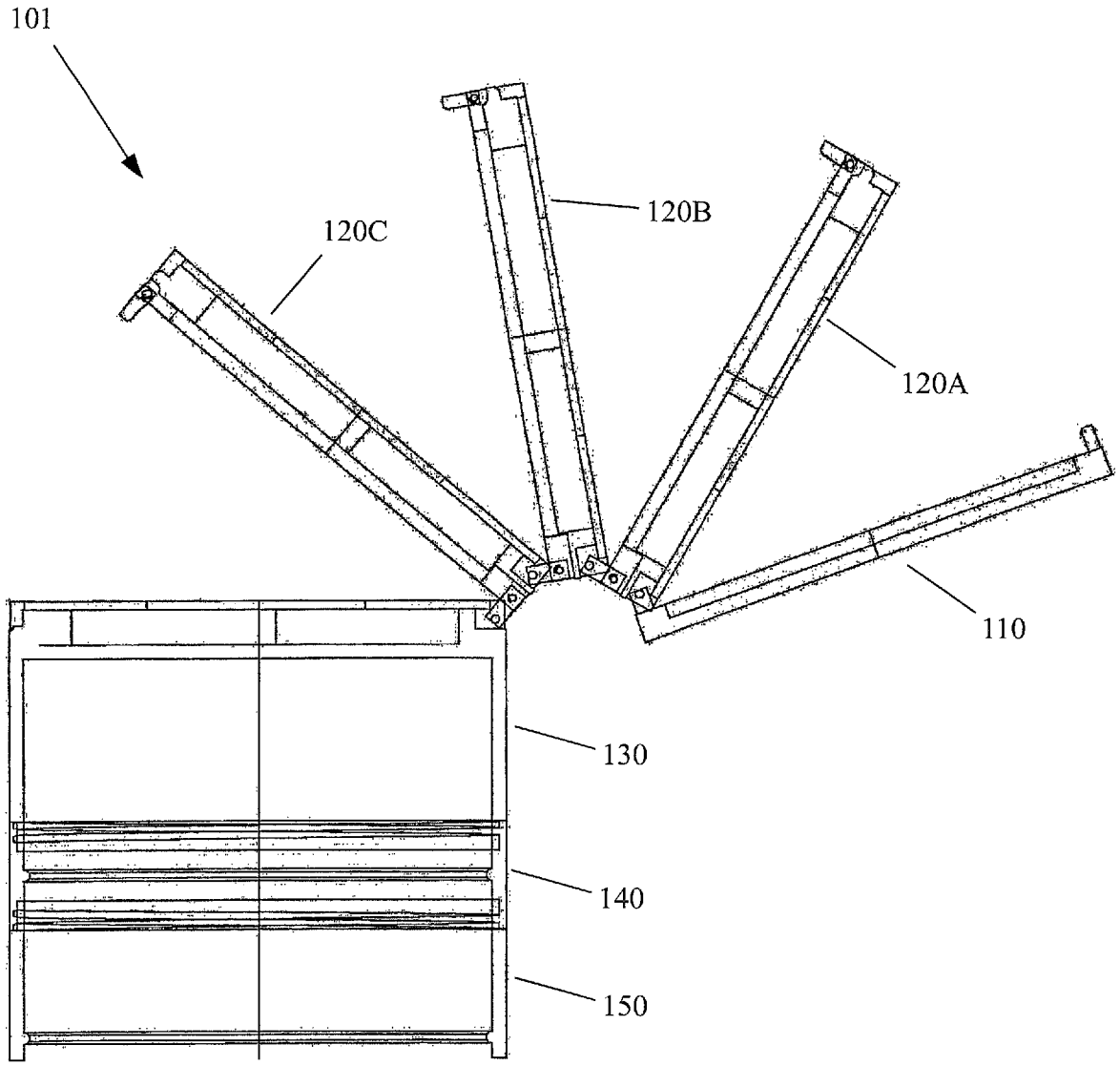
FIG. 27 shows a side view of another embodiment of a container assembly that includes a plurality of compartment layers that are pivotally coupled together using a releasable hinge arrangement as disclosed herein.

FIG. 26A through FIG. 26J show various views of a connector/compartment each transitioning from one cross-sectional shape to a different cross-sectional shape (e.g., circular to square) to accommodate the use of different cross-sectional for different layers of the same container, in conjunction with various end connection types, including a hinge connection, a friction fit connection, a female threaded connection, and a male threaded connection, and which FIG. 27 shows a side view of another embodiment—a modular multi-layer multi-compartment cosmetics container assembly 101, which includes a plurality of compartment layers that are pivotally coupled together using a releasable hinge arrangement as disclosed herein. As noted above, any number of such different and/or the same compartment layers may be coupled together, and may also be arranged in any desired order, an arrangement which may be subsequently altered at any time. Merely to be exemplary, the container assembly 101 shown in FIG. 27 includes: a lidded compartment layer 110, three shallow height cosmetic compartments (120A, 120B, and 120C), a compartment layer 130 that has a greater depth than the depth of the shallow height cosmetic compartments (120A/120B/120C) and which may have lower external threading (see the threading on the container assembly 102 in FIG. 28), which are shown pivotally coupled together using the hinge arrangement described hereinafter.

The container assembly 101 shown in FIG. 27 also includes: a coupler section 140 that is threadably coupled to the threading on the bottom of the compartment layer 130, and a bottommost container section 150 that is threadably coupled to the bottom of the lid/coupler section 140. It is noted that each of the container assemblies described herein may be utilized in any orientation, and any characterization utilized in this specification with respect to a relative position of one particular compartment and/or assembly (e.g., "topmost" or "bottommost," or "uppermost," or "lowermost") is merely intended to be descriptive for the reader, and may be based on the depiction of those compartments and features within the figure being described.

Figure 33:
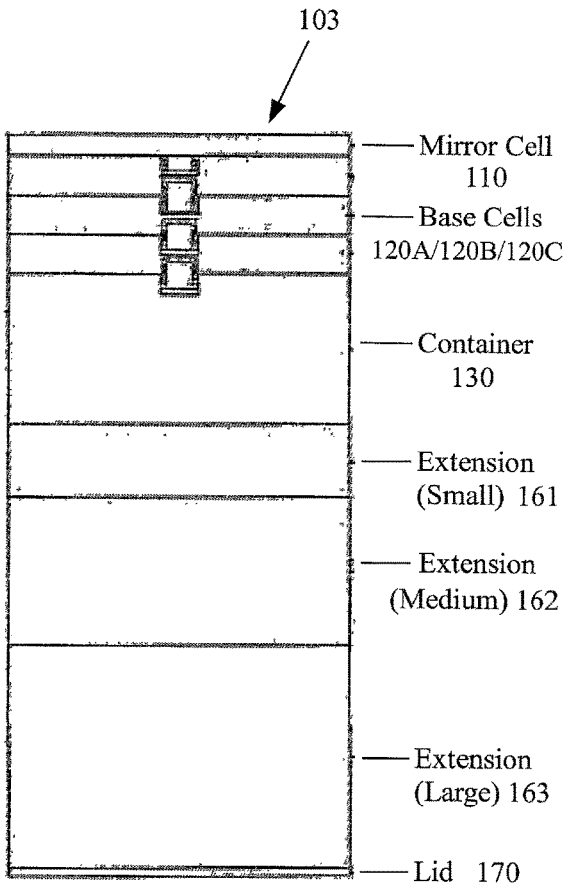
FIG. 33 is a front view of the container assembly of FIG. 30, also shown with a small extension, a medium extension, and a large extension coupled thereto, with each shown in a closed position.

As seen in FIGS. 28-31, each of the three shallow height cosmetic compartments (120A, 120B, and 120C) may be formed to include: a flat bottom wall 121, and a side wall 122 with a first end thereof joined to the bottom wall (see FIG. 30), and with a second end that has an opening that defines a cavity. (Note that the bottom wall and side wall may be formed as a single unitary part). As such, any one of the cosmetic compartments can be moved from the open position shown in those figures, into a closed position (see e.g., the "mirror cell," the "base cells," and the "container" as shown in FIG. 33), in which the compartments are all aligned and stacked on top of (adjacent to) each other, and serve to cover and protect the cosmetics in the cavity of an adjacent compartment. Note that although each of those cosmetic compartments are shown as being a hollow cylinder, other cross-sectional shapes other than a circle may also be used, as noted hereinabove (e.g., an elliptical shape—see FIG. 7, a trigonal shape, a rectangular shape, a square shape—see FIG. 13, a pentagon, a hexagon, an octagon—see FIG. 5, or any other possible shape, regular or irregular).

A releasable hinge configuration may be utilized for the container assembly 101 and/or container assembly 102, and is shown in more detail in the images of FIGS. 29-31C. As seen in FIG. 31A and FIG. 31B, the hinge arrangement for those cosmetic compartments may include a hinge knuckle 123 that may extend from a lateral portion of the bottom wall (or from a bottom portion of the side wall, or from both). In one embodiment the hinge knuckle 123 may be formed as a protrusion that has a cylindrical through-hole 123H, and a slotted opening 120P that may extend across an entire length of the hinge knuckle to define a recess having a width being less than the diameter of the through-hole 123H, and which recess extends to a depth such that it interconnects with the through-hole (see FIG. 31BB). Alternatively, the opening may terminate the hinge knuckle by effectively slicing off a portion of the knuckle protrusion thereby exposing a portion of the hole (see e.g., FIG. 31B and FIG. 31C).

The hinge arrangement for those cosmetic compartments may also include a cylindrical hinge pin 125 disposed proximate to a top portion of the side wall 122, with an axis of the hinge pin being parallel to an axis of the cylindrical through-hole 123H for each compartment (note that these axes may also be parallel to the planar top surface of the compartment). As seen in FIG. 31A and FIG. 31B, the hinge knuckle 123 may be configured to releasably and pivotally couple to the hinge pin 125 of the adjacent cosmetics compartment layer. As seen in FIG. 31B, the opening may be formed with a chamfer 123CH, to better enable the hinge knuckle 123 to snap onto the hinge pin 125 using the flat angled surface (or a curved surface) of the chamfer. As seen in FIG. 31C, the diameter of the hinge pin 125 may be slightly smaller than the diameter of the hole 123H of the hinge knuckle 123, and may thus be maintained therein using a clearance fit. Note that a friction fit may alternatively be used for the hinge pin and hole, and which friction fit may be desirable to support an opened cosmetics compartment layer in a static position with respect to the adjacent compartment to which it is hinged.

The hinge arrangement for one particular compartment may also be formed without the hinge knuckle 123 (e.g., as seen for compartment layer 130 in FIG. 27). Being formed without the knuckle may facilitate its use as a bottommost container in the assembly, as the knuckle protruding down from the flat bottom surface of the bottom wall 121 for that bottommost layer may otherwise prevent the assembly from sitting flush on a table top.

Figure 31E:
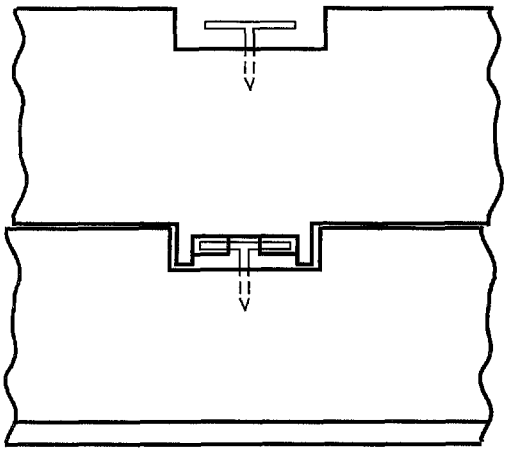
FIG. 31D and FIG. 31E show side views of another arrangement of a hinge knuckle and hinge pin, both coupled and uncoupled, where the hinge pin may be T-shaped and the opening in the knuckle that releasably receives the hinge pin may only extend across a portion of the entire length of the knuckle.
Figure 31D:
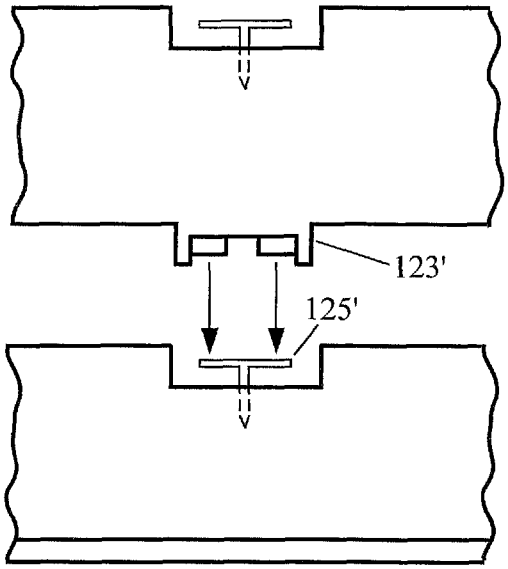

FIG. 31D and FIG. 31E show side views of another hinge arrangement, being a hinge knuckle 123' and hinge pin 125', shown both coupled together and uncoupled, where the hinge pin may be T-shaped and the hole and interconnected opening in the knuckle may only extend across a portion of the entire length of the knuckle. This hinge knuckle 123' may also snap onto the hinge pin 125' the same as with hinge knuckle 123 and hinge pin 125.

Figure 31G:
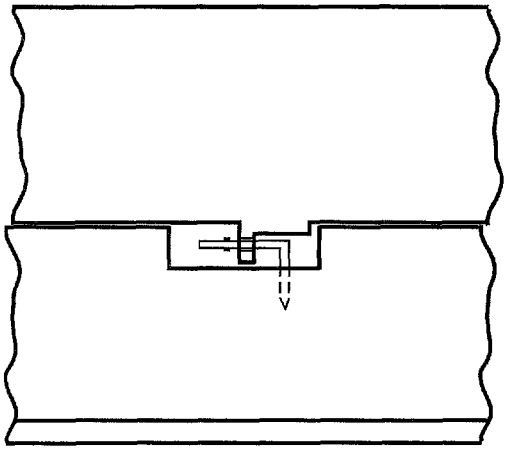
FIG. 31F and FIG. 31G show side views of yet another arrangement of a hinge knuckle and hinge pin, both coupled and uncoupled, where the hinge pin may be L-shaped and a portion of the knuckle may have a hole that releasably couples to one leg of the L-shaped hinge pin.
Figure 31F:
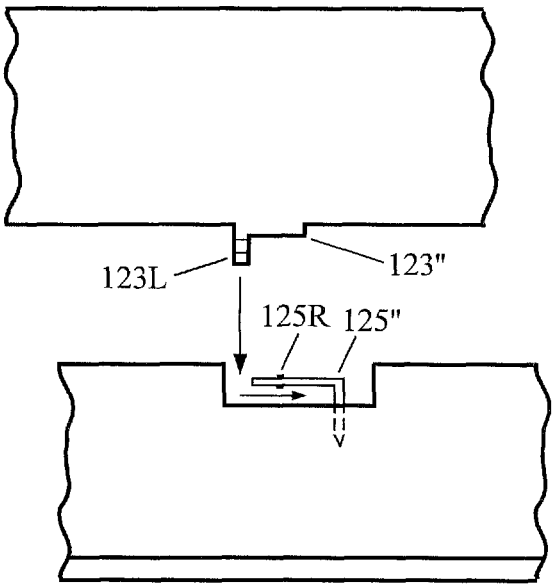

FIG. 31F and FIG. 31G show side views of yet another hinge arrangement, being a hinge knuckle 123" and hinge pin 125", shown both coupled and uncoupled, where the hinge pin may be L-shaped and a portion of the knuckle may have a hole that releasably couples to one leg of the L-shaped hinge pin. With this hinge arrangement, the lug 123L of the hinge knuckle 123" may first be inserted between the opening formed by the free standing end of the L-shaped hinge pin 125" and the adjacent wall of the compartment, and may then be translated (or rotated) into position on the hinge pin, which pin may be straight (or curved). Where the hinge pin 125" is slightly curved, the hole in the lug 123L of the hinge knuckle 123" may be oversized to nonetheless permit smooth pivotal movement between the open and closed positions of the compartment layer. To releasably retain the lug 123L of the hinge knuckle 123" at a desired central location, the hinge pin 125" may have an annular ring 125R over which the lug may be snapped through the use of a minimal amount of force (e.g., requiring in the range of between one pound to five pounds of force).

As seen in FIG. 32, a latch arrangement may be used to releasably couple a compartment layer to an adjacent compartment, after it is pivoted into the closed position. Any suitable latch arrangement known in the art may be used. Merely to be exemplary, FIG. 32A illustrates that a shaped protrusion 105P and a correspondingly shaped recess 105R may be formed on each compartment. In FIG. 32A, one of the compartment layers is shown positioned just prior to reaching the closed position, and the shaped protrusion 105P is approaching, but has not yet contacted, the adjacent compartment layer. In FIG. 32B, the compartment layer has reached the closed position, at which point the shaped protrusion 105P is releasably engaged with the shaped recess 105R to latch the two compartments together, and releasably inhibit relative motion therebetween.

Each of the compartments may be formed to have a shaped protrusion and a shaped recess to permit latching; however, just as with the hinge knuckle, the bottommost compartment layer may be formed to only have the recess, and not the protrusion, so that it does not otherwise prevent the assembly from sitting flush on a table top (or catching/snagging on something in a purse or pocket). Also, the uppermost compartment layer may be formed without an upper recess. These alternative compartment layers that may be formed without a portion of the latch (i.e., without an upper recess or without a lower protrusion) are shown, for example, in FIG. 32C.

Also, a different compartment layer may be formed for use as the uppermost compartment layer, which may be formed as a simple lid, or may be formed as a lidded compartment layer. As seen in FIG. 27, the layer 110 may be formed to include the hinge knuckle 123 as described above, and also a protrusion for latching, and may simply serve to cover the cosmetic product contained within the adjacent compartment layer (i.e., contained within compartment layer 120A). In another embodiment, the layer 110 may also be formed to include a cavity creating a lidded compartment layer, similar to the other compartment layers, but which may have the opening disposed on the same side as the hinge protrusion, so that the cavity would not be exposed when the compartment layer is in the closed position. The cavity of the lidded compartment layer 110 may be used to store cosmetics, or alternatively, it may be beneficial to the user for a mirror to be received and secured in that cavity (see e.g., the "mirror cell" of FIG. 33, and the mirror 11 of FIG. 5).

Figure 34:
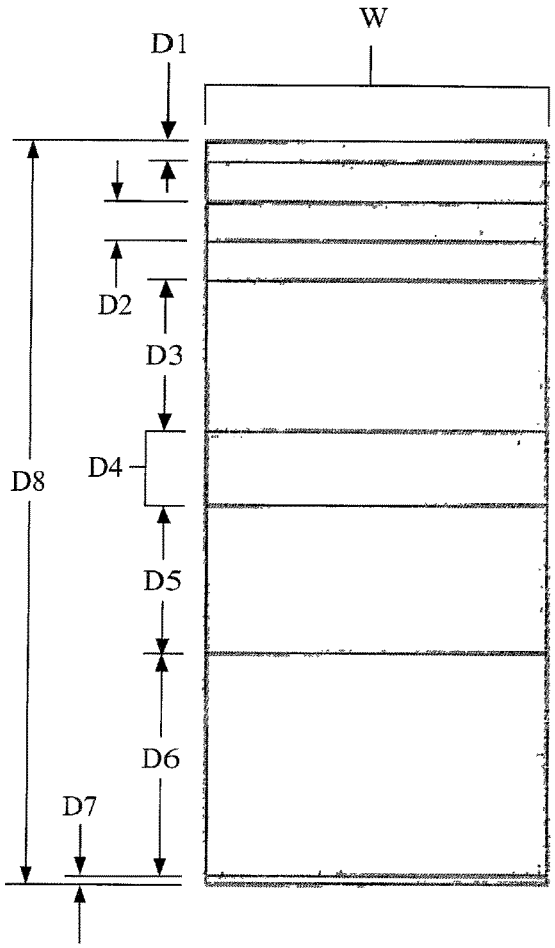
FIG. 34 is a rear view of the container assembly of FIG. 33.

Various different depths for the compartment layers, and widths (or diameters) may be used, and which may be tailored to accommodate specific cosmetic items in the respective compartments. Smaller, shallower depth compartments may be utilized for cosmetic items that are not used in large quantities, and vice versa. FIG. 34 identifies dimensions for the compartments shown therein for the container assembly 103, which, in one embodiment, merely to be exemplary, may be as follows: a width/diameter of W=60 mm; a depth D1=35 mm for the lidded compartment layer (i.e., the "mirror cell"); a depth D2=7 mm for the base cells; a depth D3=26.5 mm for the container; a depth D4=13 mm for the small extension; a depth D5=26 mm for the medium extension; a depth D6=39 mm for the large extension; a depth/thickness D7=1.5 mm for the lower lid; and an overall depth/height D8=130.5 mm. Other sizes/dimensions may of course be used.

The container assembly 103 shown in FIG. 33 may be formed the same as the container assembly 102 shown in FIG. 28 (i.e., with a lidded compartment layer 110 having a mirror, three shallow height cosmetic compartments-120A, 120B, and 120C, and compartment layer 130, all pivotally coupled together), but which may also have additional compartment layers/extensions threadably coupled thereto (e.g., the small extension 161, the medium extension 162, the larger extension 163, and the lid 170). The small extension 161, the medium extension 162, and the larger extension 163 may each be formed as a separate compartment layer (i.e., each having a bottom wall and a side wall that may be integrally formed as a single unitary part). Alternatively, each extension may be formed as only a tubular section (i.e., no bottom wall), with both external and internal threading, as they may be used to form one large cosmetics compartment, which may be accessible through the lid 170, or by unscrewing of the small extension 161 from the compartment layer 130.

As illustrated therein, in some container assembly embodiments, some of the compartment layers may be hinged together and some of the compartment layers may be threadably coupled together. In other embodiments, all of the compartment layers may be hinged together. In certain embodiments, all of the compartment layers may be threadably coupled together. Also, FIGS. 25A through 25M show a series of other connector section that may be used, which may respectively utilize: a female-female connector arrangement; a female-male connector arrangement; a female-hinge connector arrangement; a female-push connector arrangement; a push-male connector arrangement; a male-male connector arrangement; a hinge-male connector arrangement; a hinge-twist connector arrangement; a push-push connector arrangement; a hinge-push connector arrangement; a hinge-hinge connector arrangement; and a twist-male connector arrangement.

Other exemplary embodiments that may use a combination of such compartments and connectors that may be hinged, threaded, or otherwise coupled together in manner as described above, are shown in FIGS. 43-45, 46-55, and FIGS. 60A-60F.

Figure 35:
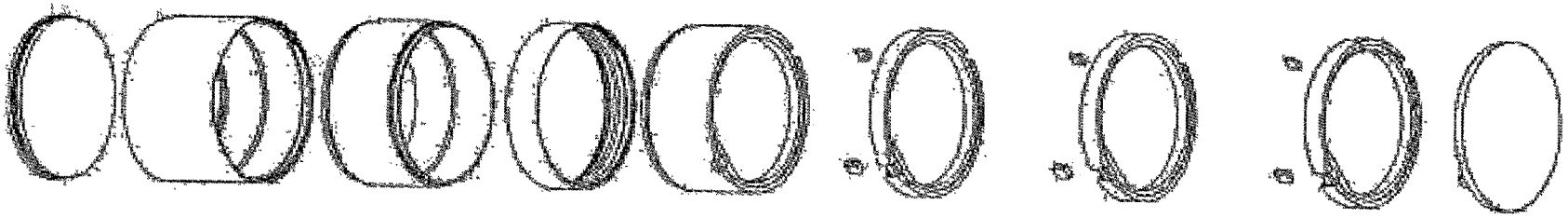
FIG. 35 is an exploded view showing the component parts of the container assembly of FIG. 33.
Figure 36:
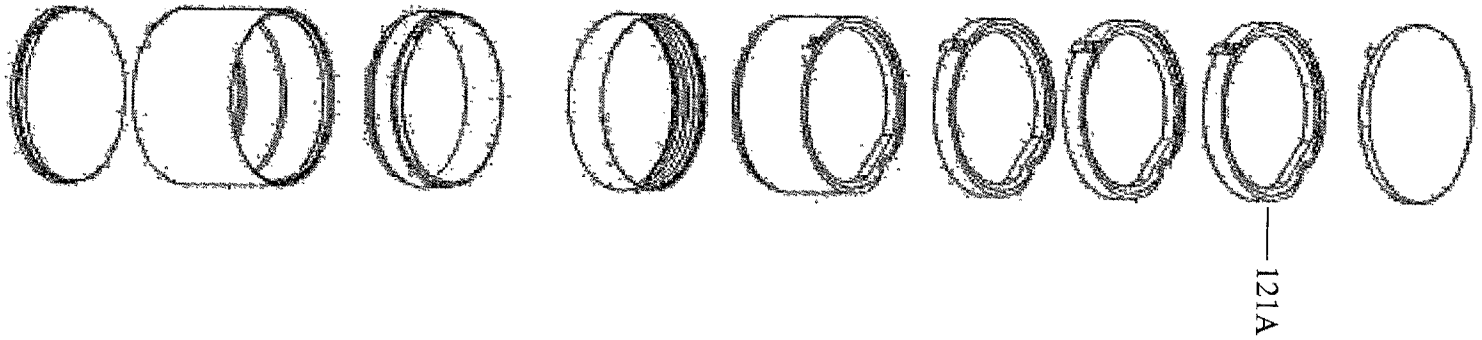
FIG. 36 is an exploded view of the component parts that may be used to form a container assembly similar to the one shown in FIG. 35, but which uses a small extension section and a male-male connector section to enlarge one of the compartment layers.

FIG. 35 is an exploded view showing the component parts that may be used to make a container assembly similar to the assembly shown in FIG. 33, but which utilizes a different configuration for the hinge and the latch, being a pivotable hinge knuckle and a pivotable latch protrusion, which are shown pivotally coupled to the respective compartment layers in the exploded view of FIG. 36.

The pivotable hinge knuckle and pivotable latch protrusion may be used on any of the different compartment layers described herein. Merely to be exemplary, a compartment layer assembly 127 is illustrated in FIGS. 37A, 37B, 38, 39, 40, and 42, which may be similar to, if not the same as, the compartment layer 120A, except for the use of a pivotable hinge knuckle and pivotable latch protrusion.

Figure 37A:
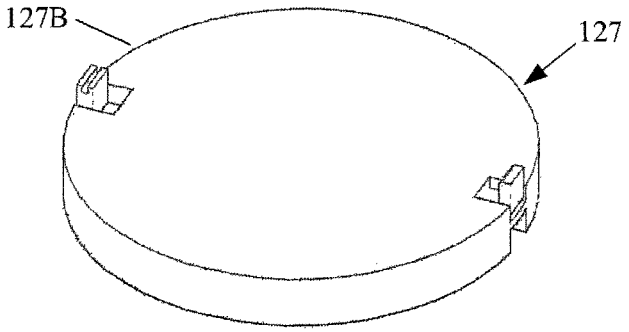
FIG. 37A is a top perspective view of a compartment layer, which includes a releasable and pivotable hinge as disclosed herein, and a pivoting latch, both of which are shown in an extended position.
Figure 37B:
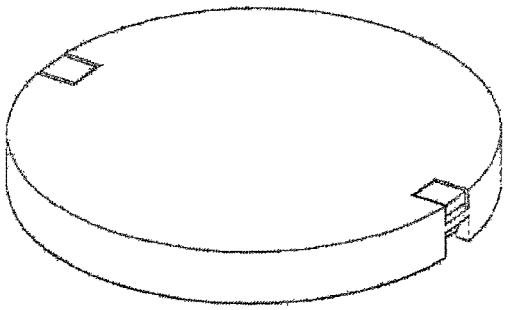
FIG. 37B is the top perspective view of the compartment layer of FIG. 37A, but showing both the pivoting hinge and the pivoting latch after having been pivoted into a retracted position.
Figure 40:
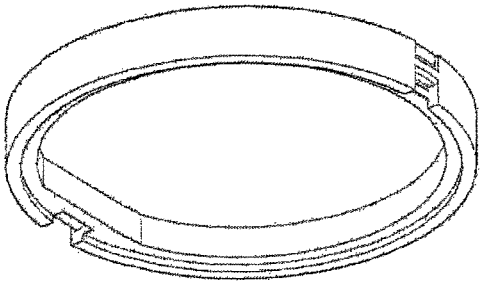
FIG. 40 is a bottom perspective view of the compartment layer shown in FIG. 37B.
Figure 38:
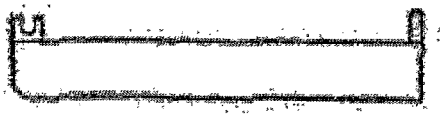
FIG. 38 is a side view of the compartment layer shown FIG. 37A, with the pivoting hinge and the pivoting latch in an extended position.
Figure 39:
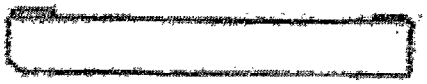
FIG. 39 is a side view of the compartment layer shown in FIG. 37B, with the pivoting hinge and the pivoting latch in a retracted position.

FIG. 37A and FIG. 38 show the pivotable hinge knuckle and the pivotable latch protrusion when in an extended position, while FIG. 37B, FIG. 39, FIG. 40, and FIG. 42 show the pivotable hinge knuckle and the pivotable latch protrusion when in a retracted position. The hinge knuckle and the pivoting latch protrusion may be fully retracted within the compartment layer, when in a retracted position, or a slight portion may still protrude therefrom, as seen in FIG. 39, to assist the user with toggling of those parts from the retracted position into the extended position. Also, in another embodiment, the pivotable hinge knuckle and the pivotable latch may be able to fold, bend, or otherwise retract such that when in the folded position, the exposed surface portion of the knuckle/latch appears to be substantially smooth and continuous within respect to the flat surface of the adjacent surface portion of the layer into which it is folded.

At least two different embodiments may be used to accomplish pivotal attachment of the pivotable hinge knuckle and the pivotable latch protrusion to the body 127B of the compartment layer assembly 127.

Figure 41A:
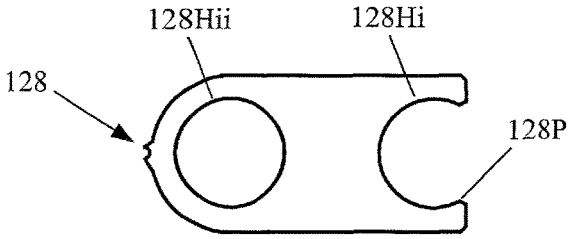
FIG. 41A is an enlarged side view of a first embodiment of a hinge knuckle that may be used in the compartment layer of FIG. 37A.

In the first embodiment shown in FIG. 41A, the hinge knuckle 128 may be formed similar to the hinge knuckle 123, i.e., having a cylindrical through-hole 128Hi, a slotted opening 128P that may extend across an entire length of the hinge knuckle, and has a width being less than the diameter of the through-hole 128Hi, and which recess interconnects with the through-hole. This portion of the hinge knuckle 128, as with the hinge knuckle 123, may be used for releasable coupling of the compartment layer assembly 127 to an adjacent compartment layer. The hinge knuckle 128 may also be formed with a second hole 128Hii, which may be pivotally mounted to a hinge pin 129 that may be secured and/or implanted within a recess in a portion of the body 127B of the compartment layer assembly 127, to provide for pivotal mounting of the hinge knuckle, and movement between the extended and retracted positions. Once the hinge pin 129 is received in the recess, as shown for example in FIG. 41B, the recess can filled with epoxy, etc., to positively retain the hinge pin therein, or alternatively, the hinge pin 129 may be mechanically fastened in the recess, or other methods and structural arrangements for such securement of the pin may alternatively be used, as are known in the art.

Figure 41C:
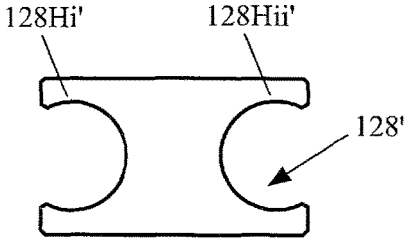
FIG. 41C is an enlarged side view of a second embodiment of a hinge knuckle that may be used in the compartment layer of FIG. 37A.
Figure 41B:
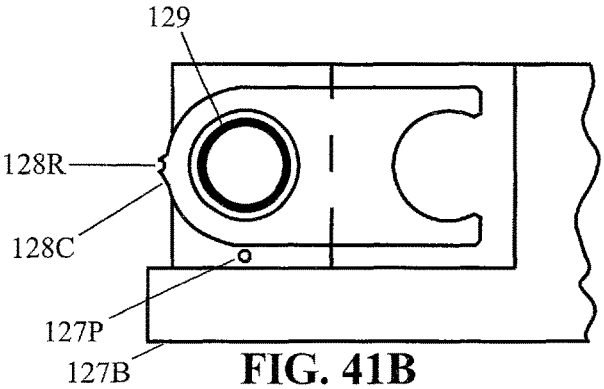
FIG. 41B is a side view of the hinge knuckle of FIG. 41A, but shown after being pivotally secured to the compartment of FIG. 37A, and being shown in the retracted position.
Figure 41D:
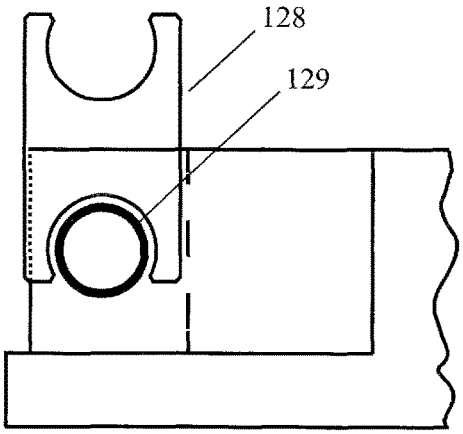
FIG. 41D is a side view of the hinge knuckle of FIG. 41C, but shown after being pivotally secured to the compartment of FIG. 37A, and being shown in the extended position.
Figure 46A:
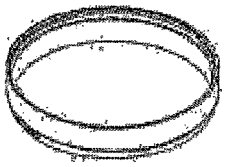
FIG. 46A is a perspective view of a male-female connector.
Figure 46B:
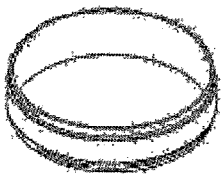
FIG. 46B is a perspective view of the male-male connector.
Figure 46:
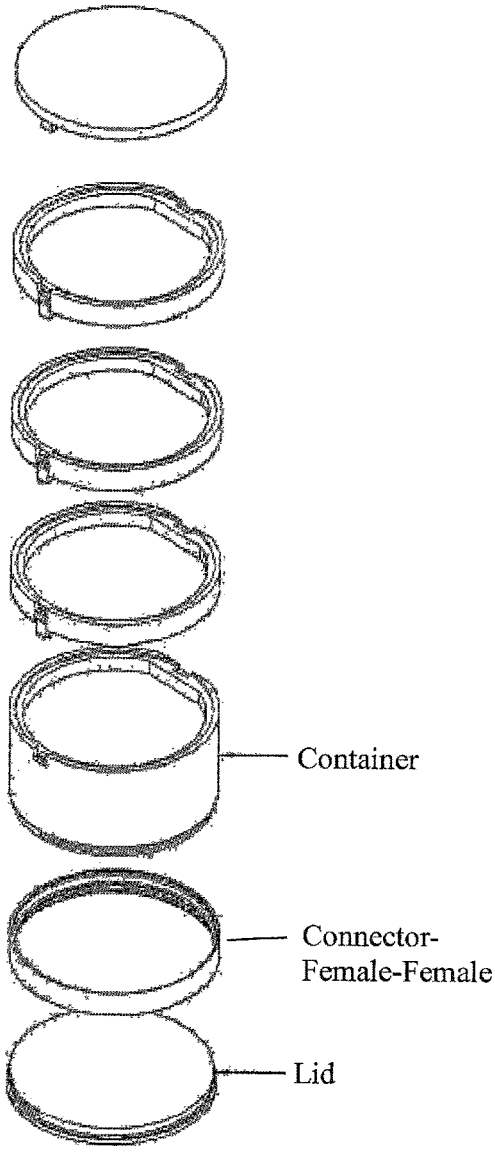
FIG. 46 is the exploded view of FIG. 43, but shown with the small extension section and the male-female connector replaced with a female-female connector, being usable to form an even smaller container assembly.
Figure 53:
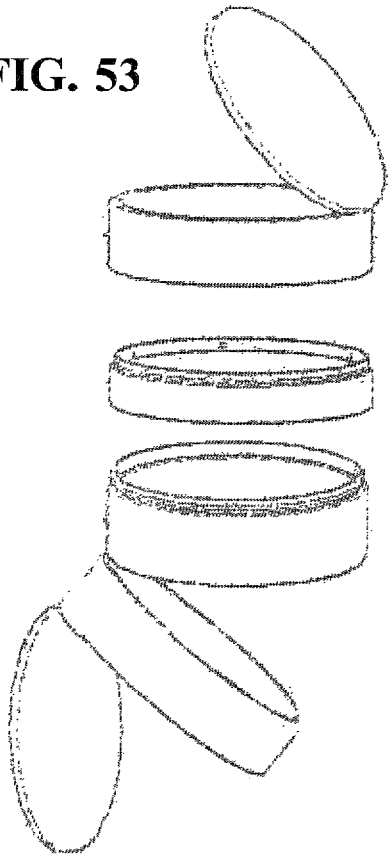
FIG. 53 is a first exploded perspective view of the component parts that may be used to form a double lidded container assembly.
Figure 54:
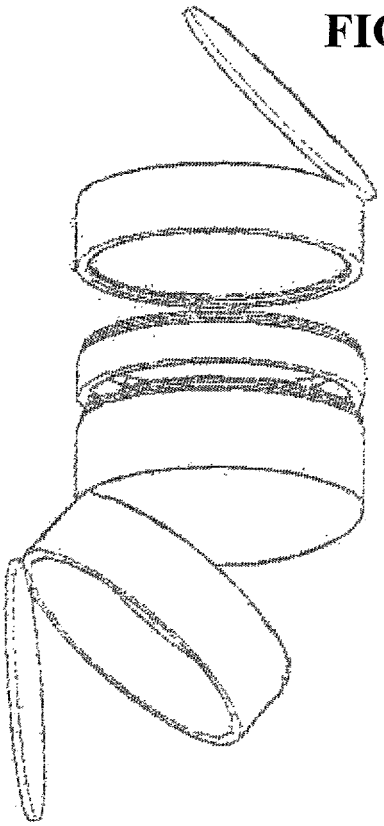
FIG. 54 is a second exploded perspective view of the component parts of FIG. 53.
Figure 55:
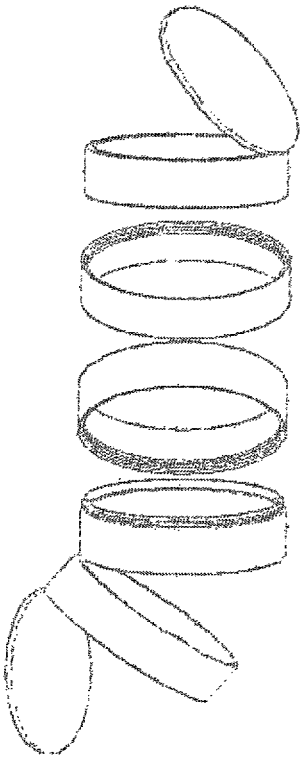
FIG. 55 is a third exploded perspective view of the component parts of FIG. 53, but showing an additional extension section that may be used therewith.
Figure 56A:
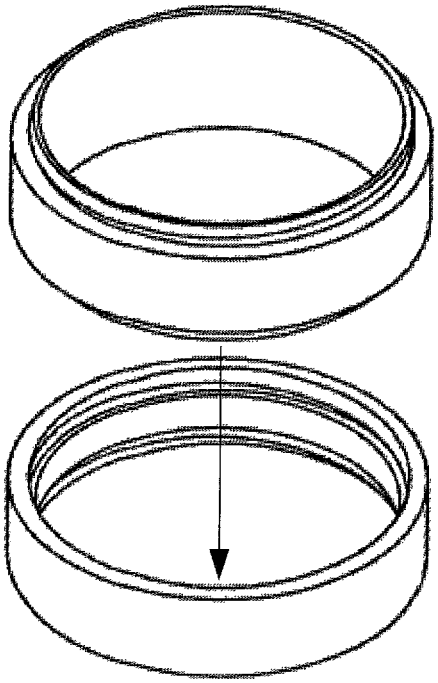
FIG. 56A is a top perspective view showing threaded coupling of a male-male connector to a female-female connector.
Figure 57:
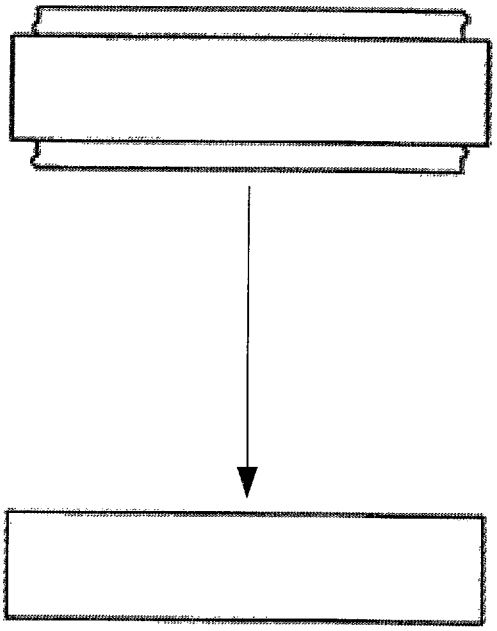
FIG. 57 is a side view showing the threaded coupling of the male-male connector to the female-female connector shown in FIG. 56A.
Figure 56B:
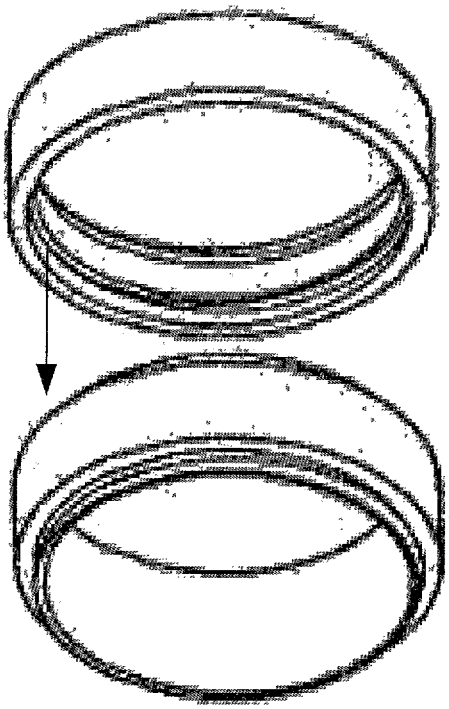
FIG. 56B is a bottom perspective view showing the threaded coupling of the male-male connector to the female-female connector, as seen in FIG. 56A.
Figure 58A:
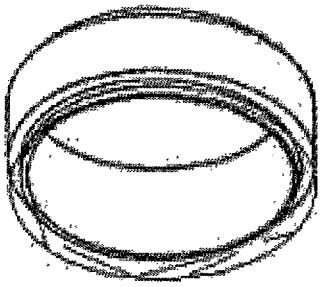
FIG. 58A, FIG. 58B, FIG. 58C, and FIG. 58D show different views of a threaded connector member.
Figure 58B:
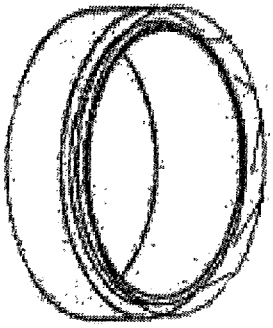
Figure 58C:
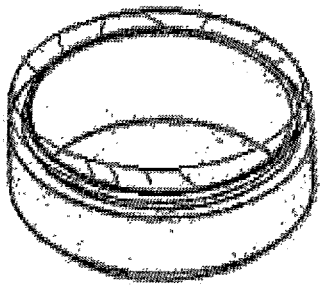
Figure 58D:
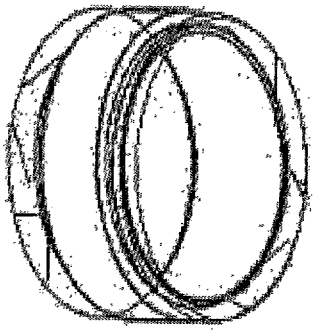
Figure 59:
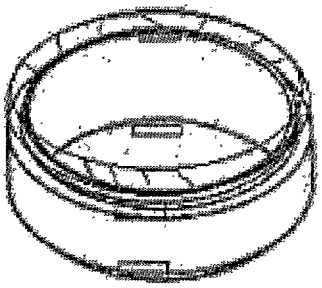
FIG. 59 shows a perspective view of another connector member.
Figure 60A:
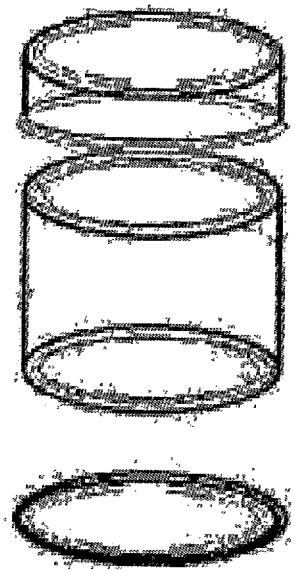
FIG. 60A, FIG. 60B, FIG. 60C, FIG. 60D, FIG. 60E and FIG. 60F show various different covers and connector sections that may be used interchangeably, and in conjunction with the various different compartment layers, including, for example: threaded upper and lower covers usable with a cylindrical middle section (FIG. 60A) so it can be accessed/opened from either end; coupling the cylindrical center section to another compartment in conjunction with a cover to extend its length.
Figure 60B:
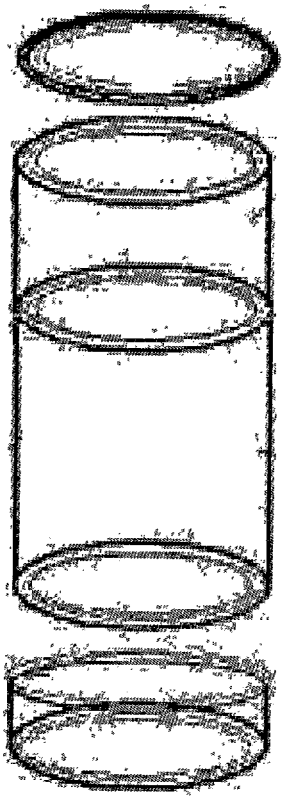
Figure 60C:
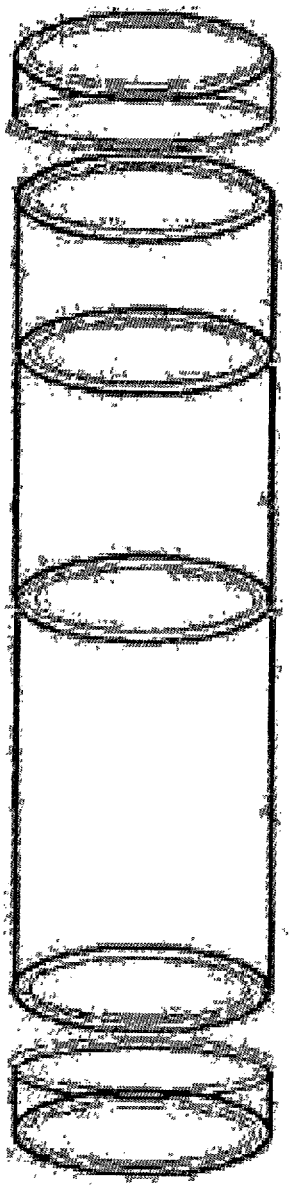
Figure 60D:
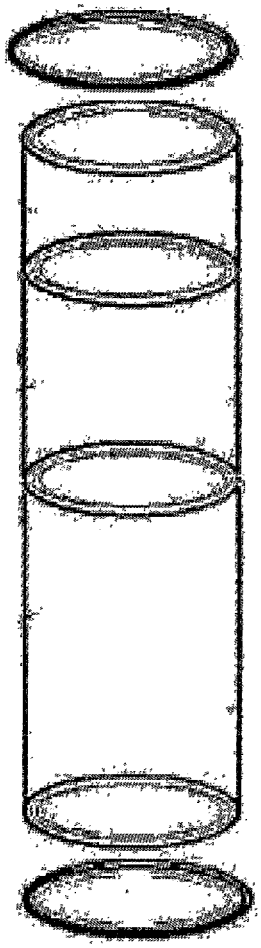
Figure 60E:
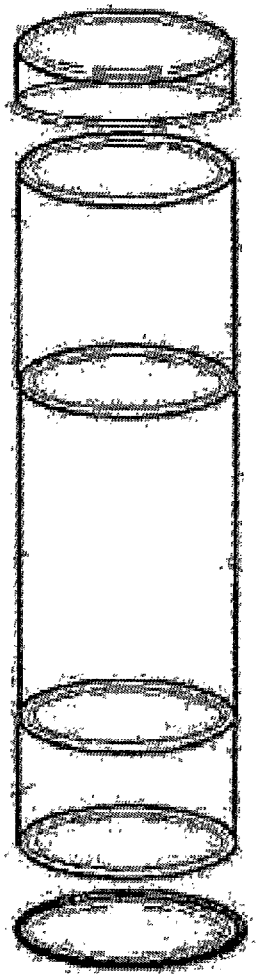
Figure 60F:
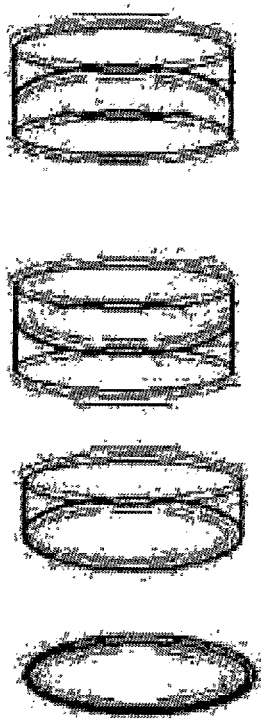

As seen in FIG. 41B, a detent arrangement may be used to releasably secure the hinge knuckle 128 in the extended position. The detent arrangement may be formed by a pin 127P being secured to the body 127B, and a corresponding recess 128R may be formed in the knuckle 128. A curved surface 128C may facilitate snapping of the pin 127P into the recess 128R, as the hinge knuckle 128 is rotated 90 degrees into its extended position. The same or a similar detent arrangement may also be used to releasably secure the knuckle 128 in the retracted position.

In the second embodiment shown in FIG. 41C, the hinge knuckle 128' may be formed the same as hinge knuckle 128, except that both ends may have a recess interconnected with the respective holes (i.e., also having a recess into the hole 128Hi' in addition to the recess into hole 128Hii'). With this embodiment, the user is able to releasably attach and detach the hinge knuckle 128 with respect to the compartment layer 127, as needed, using the opening into hole 128Hi', and may releasably couple the other end to an adjacent compartment layer using the opening into hole 128Hii'. This embodiment may eliminate the need for a different topmost and bottom-most container layer that is formed without the protruding hinge (and without the latch protrusion/recess).

As seen at least in FIG. 42, the latch protrusion may be formed the same, being able to pivot the same as described herein for the hinge knuckle, and may also make use of the detent arrangement(s).

Figure 61:
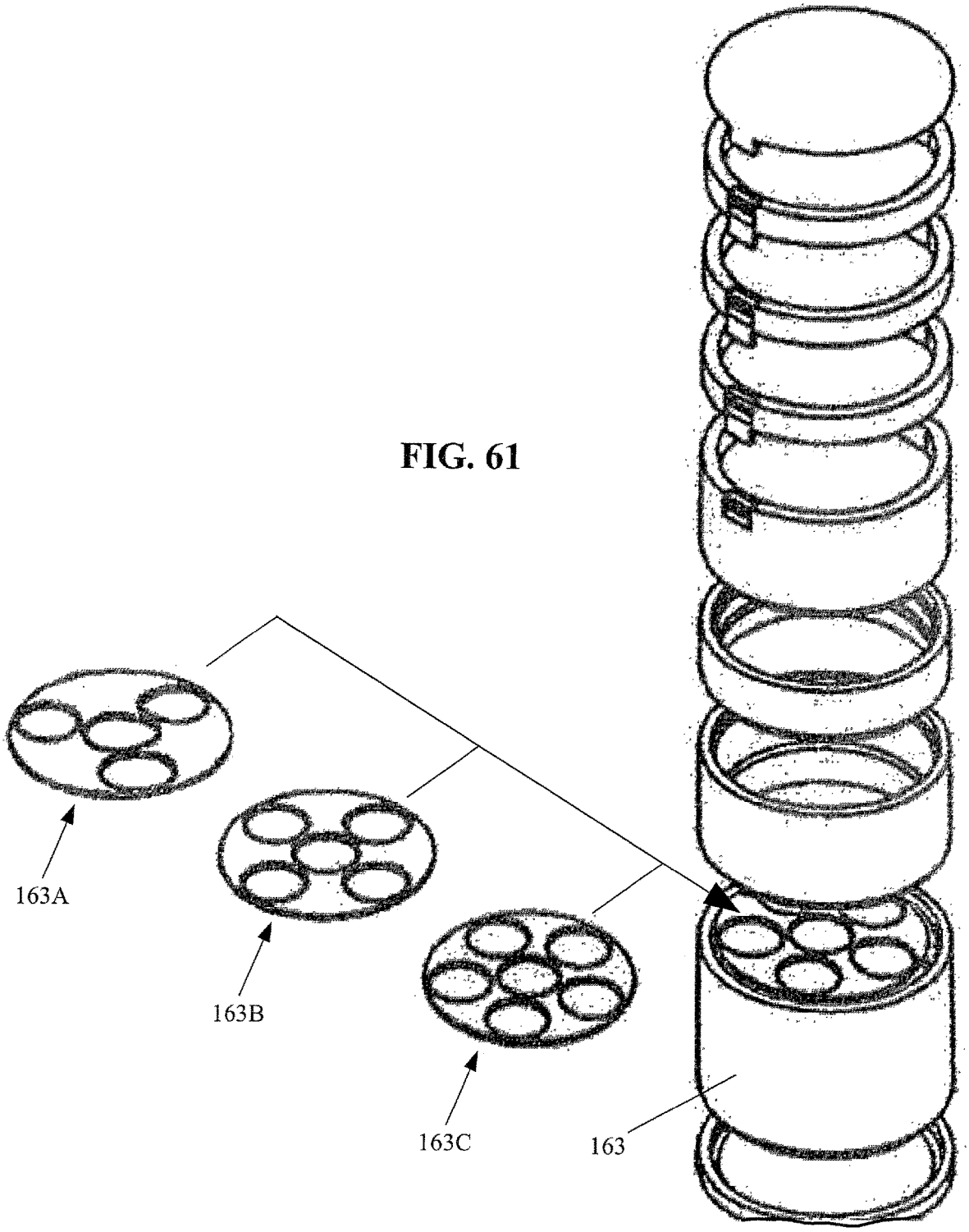
FIG. 61 is an exploded view showing the component parts of FIG. 35, and which also shows a plurality of different divider plates/disks that may be coupled to one of the connector or container sections to receive and support tall items therein in a spaced apart arrangement, items such as lipstick, eye shadow, etc.

FIG. 61 is an exploded view showing the component parts of FIG. 35, and which also shows a plurality of different divider plates/disks that may be coupled within one or more of the connector sections or compartment layers, in order to receive and support a plurality of items in a spaced apart arrangement, items such as: a tube of lipstick; an eye-liner container; a nail file; a makeup brush; a container of perfume; a stick of eye-shadow; a bottle of nail polish; etc.

The divider plate may be utilized on a cosmetics compartment layer that has a greater width than height, or on a cosmetics compartment layer that has a greater height than width, or on a cosmetics compartment layer that has the same width and height.

The divider plate/disk is formed with a plurality of shaped openings that are configured to create a plurality of sub-compartments therein, each configured to respectively support a cosmetic item therein. Where the divider plate is used on a cosmetics compartment layer that has a greater height than width, it may be used to support tall items, and an axis of the supported cosmetics item may be supported parallel to an axis of the cosmetics compartment layer into which it is received (see e.g., FIG. 62B).

As seen in FIG. 61, different divider plates may be interchangeably received in the compartment layer or layers, to accommodate different numbers of cosmetic items. For example, the divider plate 163A has four openings, the divider plate 163B has five openings, and the divider plate 163C has six openings.

Figure 62A:
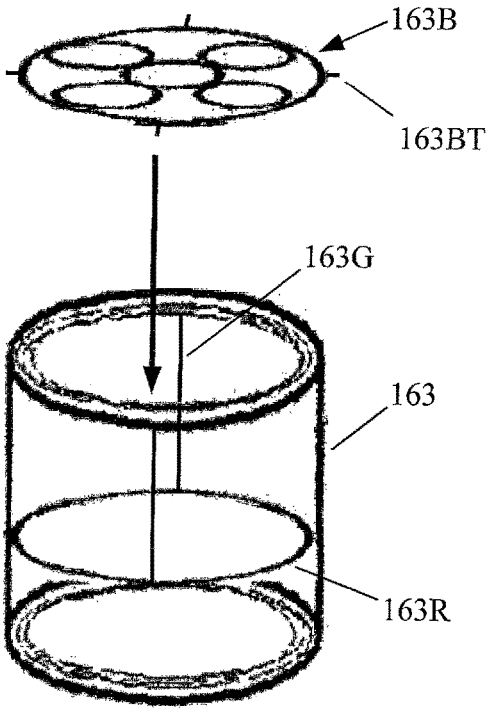
FIG. 62A is an exploded transparent view of component parts that may be used to form another container assembly, showing one of the divider plates of FIG. 61 just prior to being positioned within the container section.

To accomplish such interchangeability, in one embodiment, a portion of the divider plate may be configured to snap into a portion of the cosmetics compartment layer, which may be accomplished in any suitable manner. For example, as seen in FIG. 62A, the divider plate 163B may have a plurality of prongs 163BT (e.g., four prongs) protruding from the peripheral edge of the plate, and the container (e.g., the large extension 163) may have a corresponding plurality of grooves 163G (i.e., 4 grooves) that may be oriented in the axial direction (alternatively the grooves could create a helical track that may serve to retain the divider plate therein). The divider plate 163B may be releasably received in the container extension 163 by aligning the four prongs 163BT with the four grooves, and then sliding/translating the plate inwardly. The prongs may be received in the grooves in a clearance fit or a slight friction fit, until reaching the installation location, at which point the grooves may become shallower to engage the prongs in a friction fit to maintain the divider plate at that location. Additionally, or alternatively, the divider plate may be slid inwardly using a clearance fit until the prongs reach an annular recess (e.g., indicated by the annular shape 163R), which may be formed to a depth being greater than the depth of the grooves 163G, so that the prongs may be received into and trapped by the annular recess.

Alternatively, a friction fit may be used for the divider plate with respect to the interior of the compartment layer, without the use of the prongs and grooves, and may also be without the use of the annular recess.

Figure 62C:
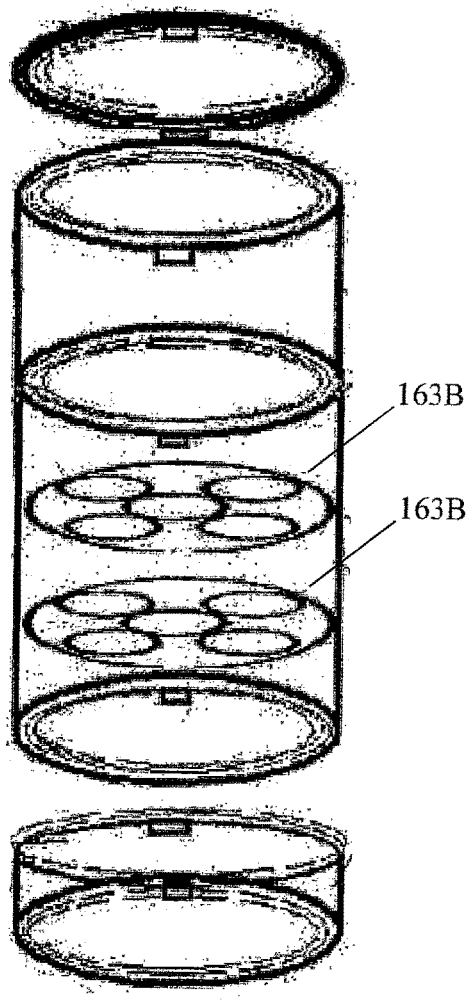
FIG. 62C is an exploded transparent view illustrating component parts that may be used to form yet another container assembly, showing two of the divider plates of FIG. 61 positioned within a container section.
Figure 62B:
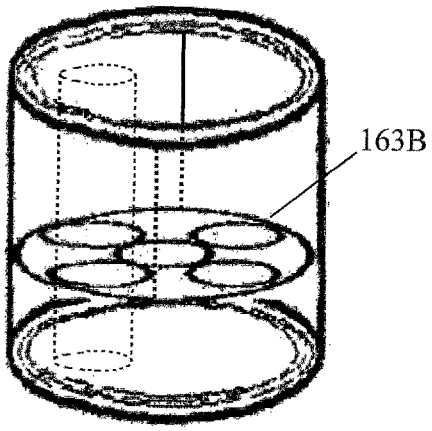
FIG. 62B is the view of FIG. 62A, but shown just after the divider plate has been positioned within the container section.
Figure 62D:
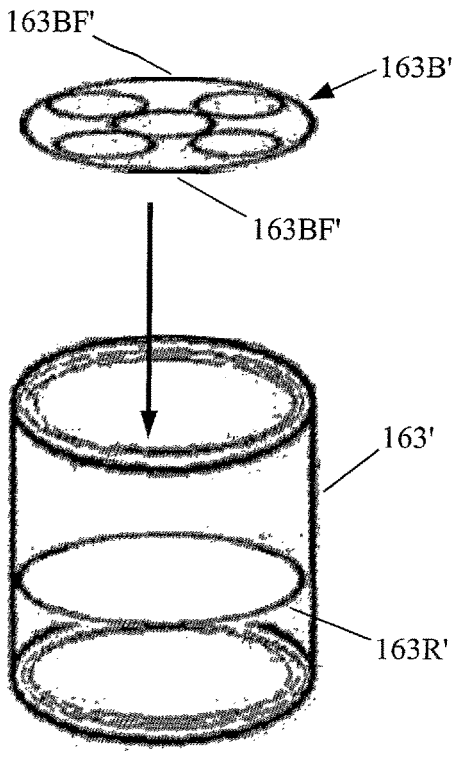
FIG. 62D is an exploded transparent view showing component parts that may be used to form another container assembly, showing one of the divider plates of FIG. 61 just prior to being positioned within the container section.
Figure 62E:
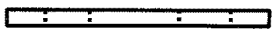
FIG. 62E and FIG. 62F are two divider disks/plates similar to those of FIG. 61, being formed respectively as a thin plate member and a thicker plate member.
Figure 62F:
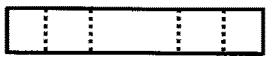
Figure 62G:
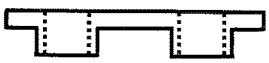
FIG. 62G is a divider plate similar to those of FIG. 61, being formed to be thicker only at the openings, which local thickening may be in the form of hollow cylindrical protrusions.
Figure 64:
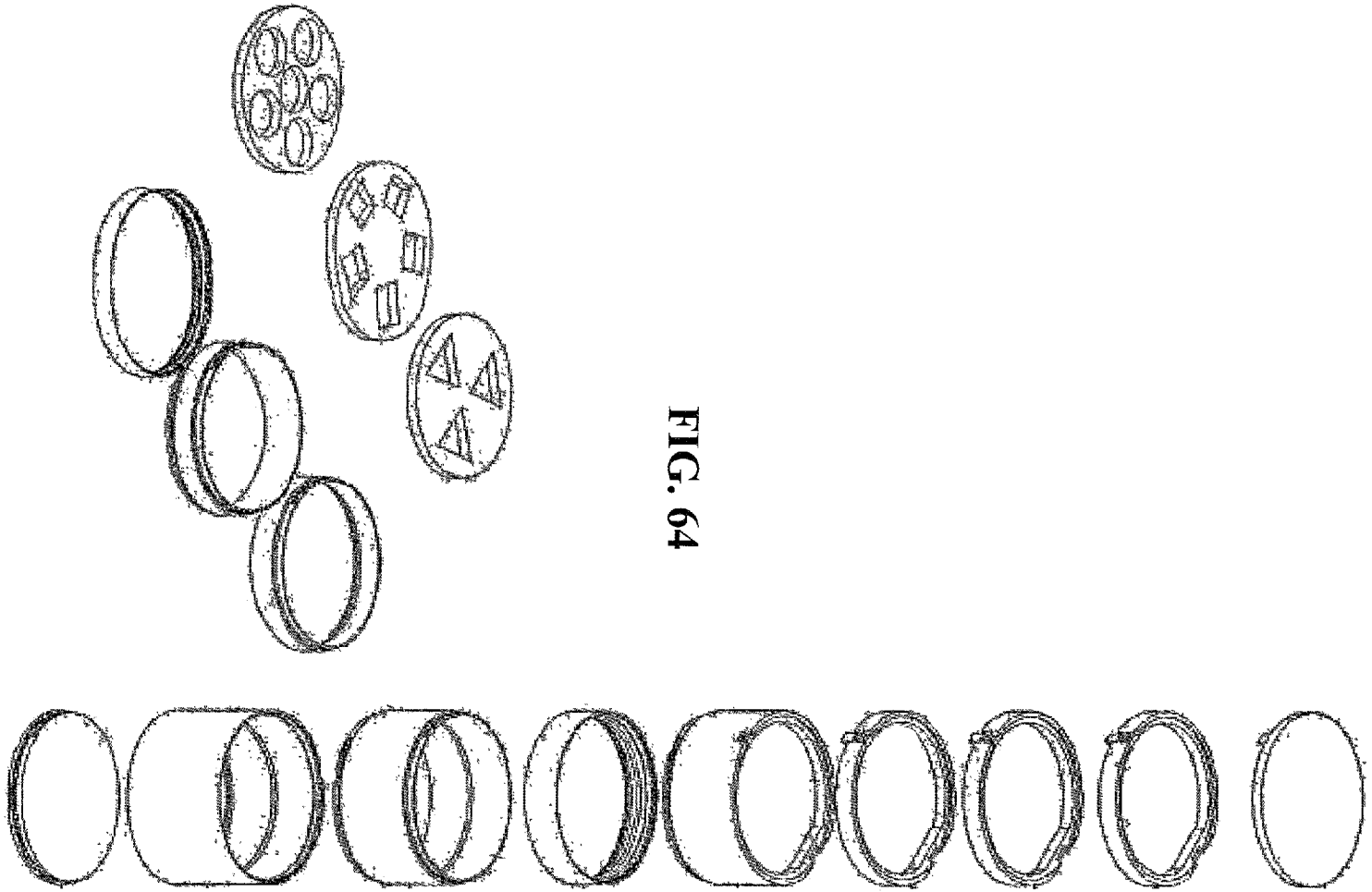
FIG. 64 is an exploded view showing all of the component parts illustrated in FIGS. 63, 63A, 63B, 63C, 63D, 63E, and 63F.
Figure 65:
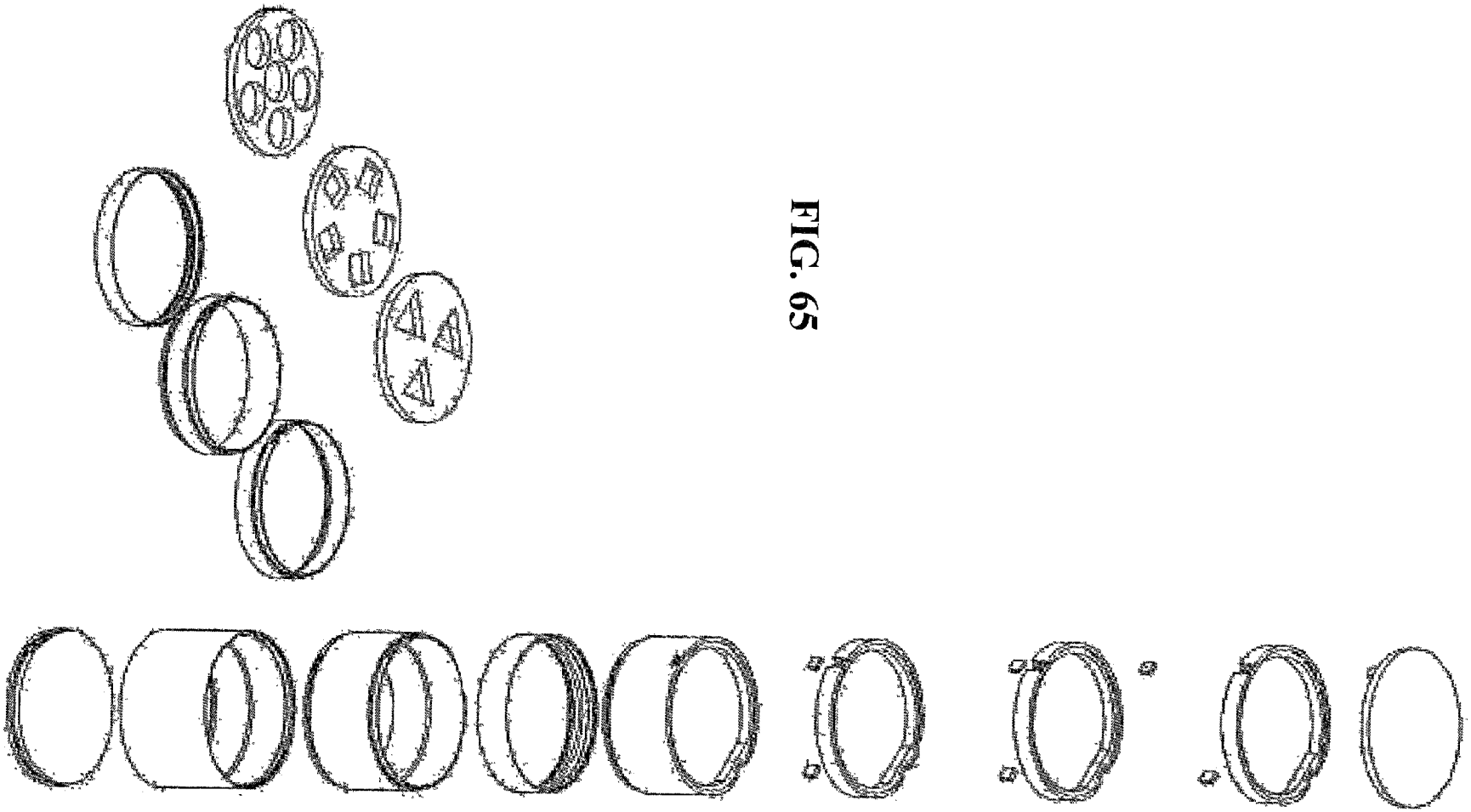
FIG. 65 is the exploded view of FIG. 64, but is also shown with the pivotable hinges and pivotable latch members decoupled from the respective container sections.
Figure 66:
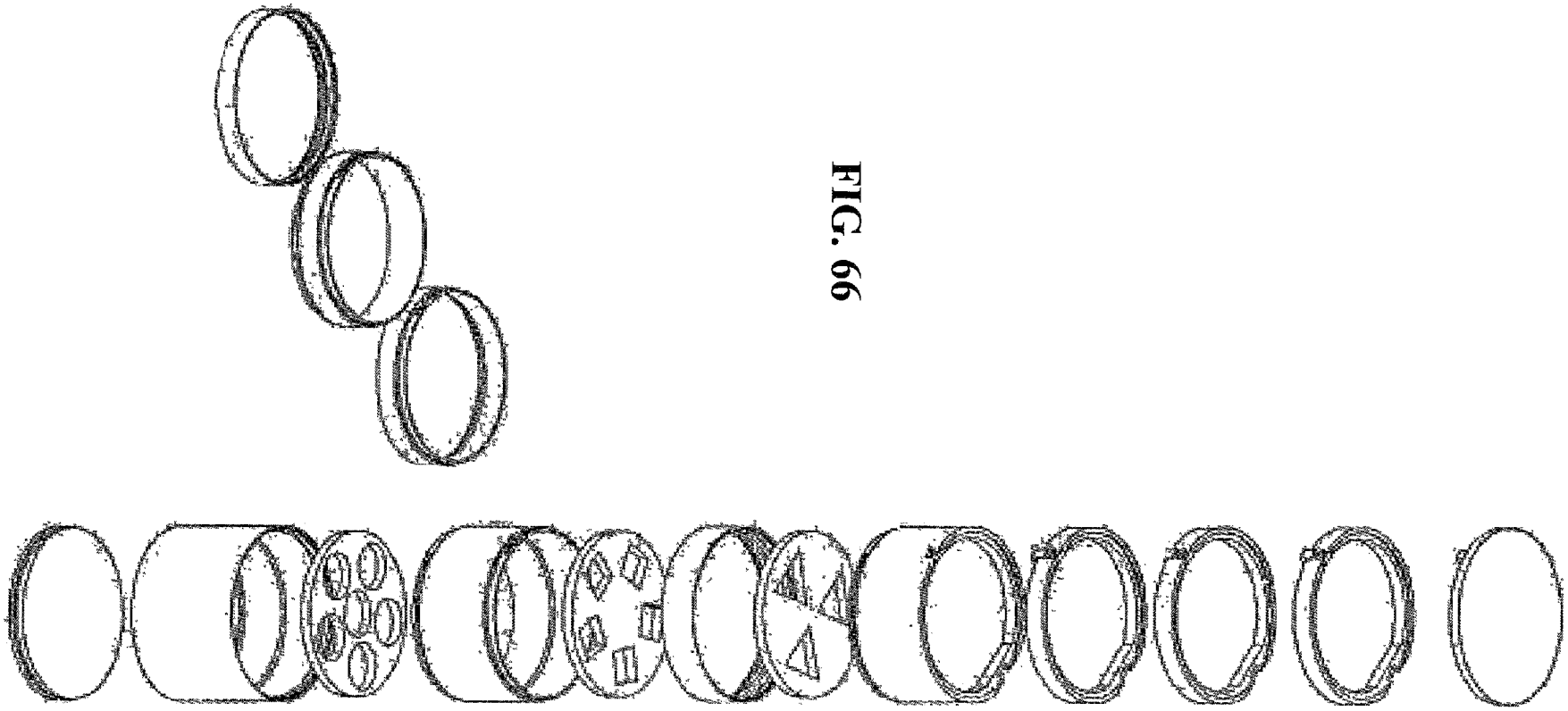
FIG. 66 is the exploded view of FIG. 65, but is shown just prior to a set of divider members being inserted into respective container/connector sections.

In another embodiment, to accomplish such interchangeability, as may be seen in FIG. 62D, an annular ring 163R' may protrude from the interior surface of the container (e.g., from the interior surface of the large extension 163). The divider plate 163B' may be releasably received in the container extension 163 by simply sliding/translating the plate inwardly, as the outer periphery of the divider member may be sized to be received in a clearance fit within the interior surface of the container. Additionally, a portion of the interior surface of the container immediately adjacent to the annular ring 163W may be sized to engage the outer periphery of the divider member in a friction fit, to maintain the divider plate at that location against inadvertent removal as a result of a force provided by insertion/removal of cosmetic items into its openings. Additionally, a second annular ring (not shown in FIG. 62D) may be formed to protrude from the interior surface of the container the same as annular ring 163R', but being spaced apart therefrom, so that each of the two annular rings may support a respective divider plate/disk. Use of two divider plates may provide better support for the cosmetic items received into its openings. Each divider plate may be inserted from opposite open ends of the container extension 163. To assist with insertion of the two divider plates 163B' where only one of the ends of the container may be open, each divider plate may have one or two flattened sides 163BF', permitting its initial insertion into the container in an edge-wise orientation, after which it may be rotated into position once being moved past the first of the two annular rings 163R'. Also, to provide better support for the cosmetic items received into its openings, the divider plate may be formed to be thicker overall (compare the thickness shown for the divider plate in the side view of FIG. 62E with the divider plate of FIG. 62F), or it may be formed to be thicker only at the openings, which local thickening may be in the form of hollow cylindrical protrusions (see FIG. 62G).

A user could also add a small amount of adhesive at the annular ring or rings 163R' if it is desired to make the arrangement permanent, rather than easily interchangeable.

In yet another embodiment, to accomplish such interchangeability, the divider plate may be formed to include external threading that may threadably couple to internal threading formed at a desired portion/depth of the compartment layer/container.

Figure 67:
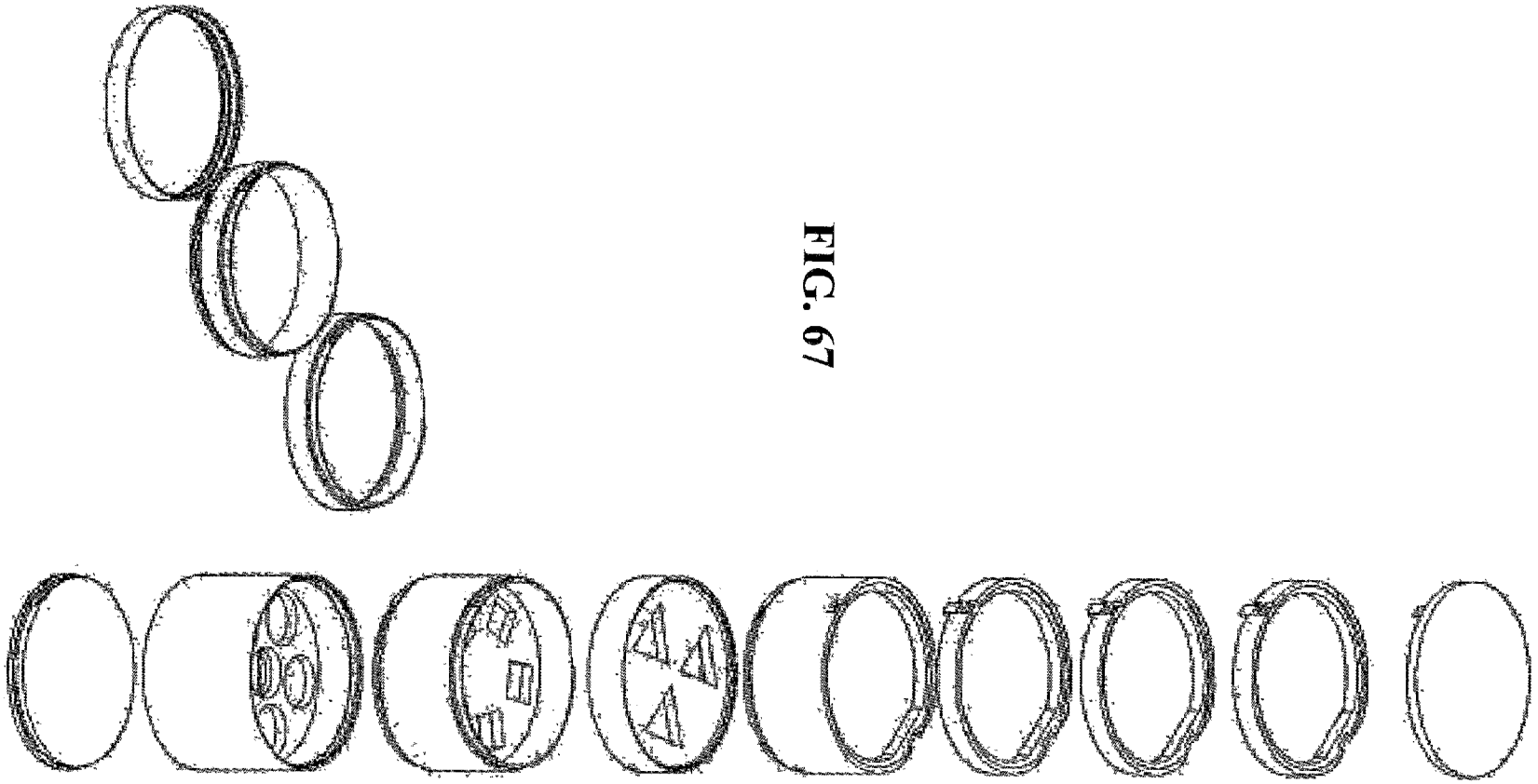
FIG. 67 is the exploded of FIG. 66, but is shown with the three different divider sections after having been respectively inserted and retained within three of the container/connector sections.
Figure 68:
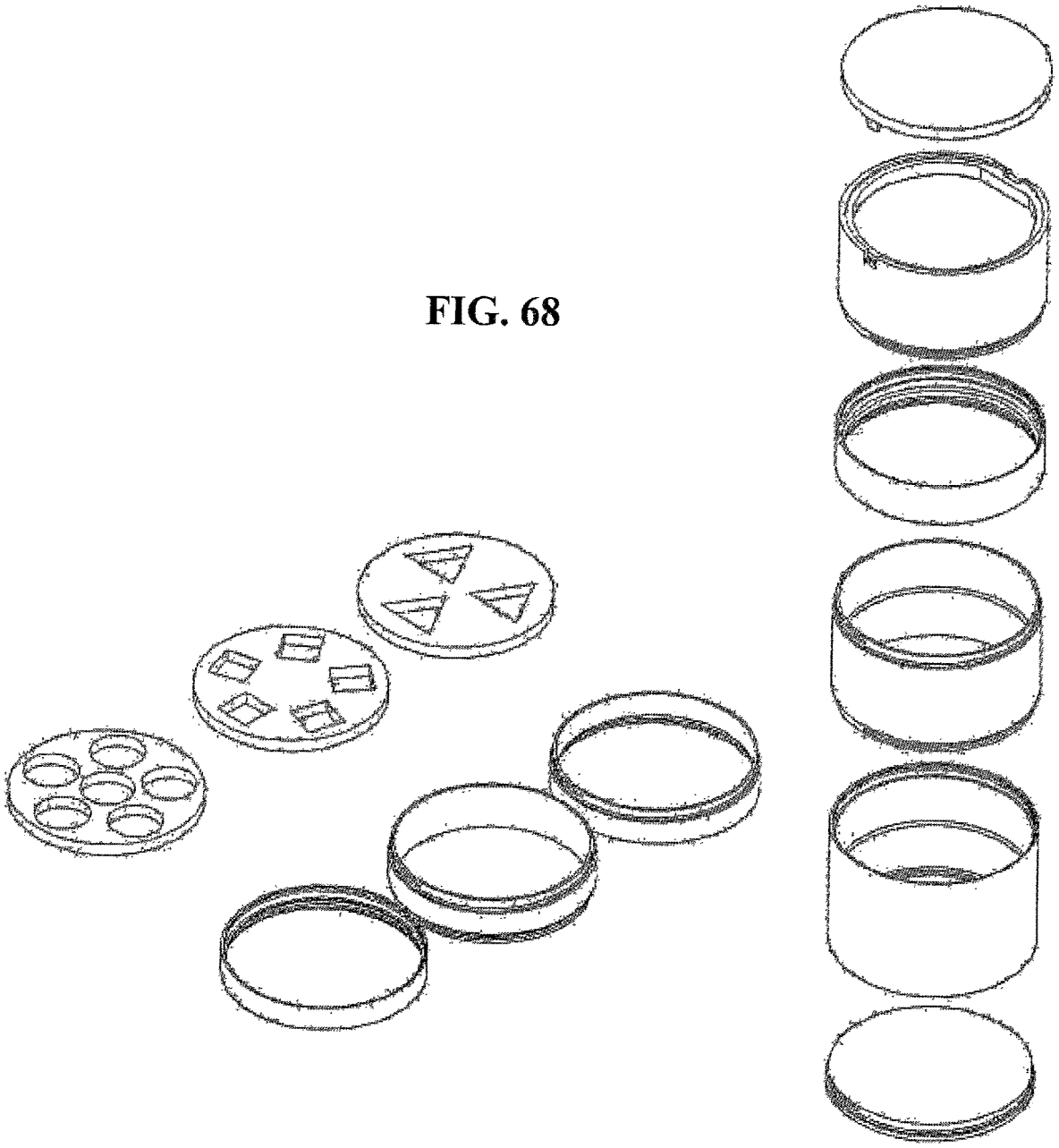
FIG. 68 is the exploded view of FIG. 64, but which omits the three small uppermost container sections, and may form a different container assembly.
Figure 75:
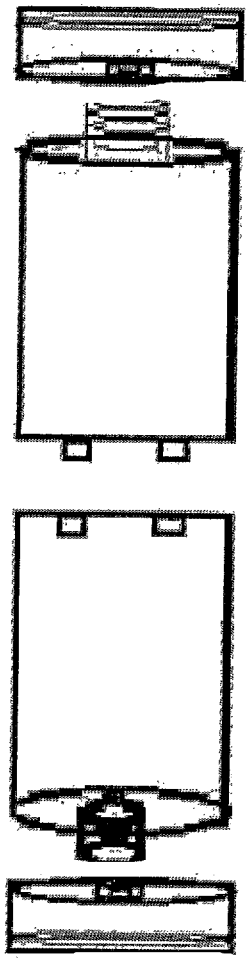
Figure 76:
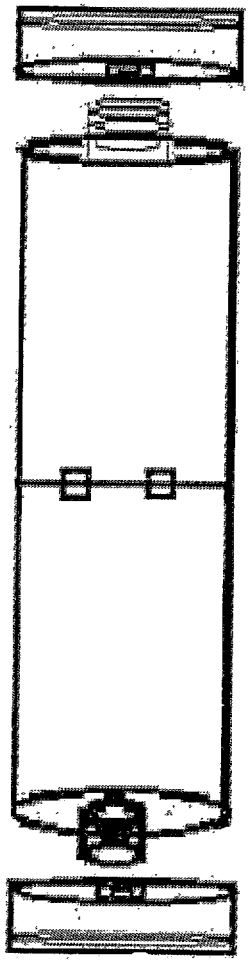
Figure 80:
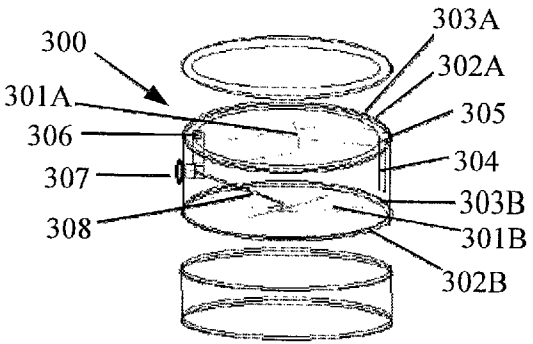

The compartment/container section of FIG. 62C is also shown formed so that it may support two of the divider plates 163B therein. Also, as seen in FIGS. 63A-63C, different divider plates may be formed with different shaped openings, to support different items, which different divider plates may positioned in different compartment layers, as shown in FIG. 67. In yet another embodiment, as seen in FIG. 73, one divider plate may be formed with a plurality of openings, at least two of which may have different shapes, or all of which openings may have different shapes.

Another container assembly embodiment is shown in FIGS. 77-80, and may be formed to include one or more cosmetics compartment layers as described hereinabove (e.g., a mirror compartment layer 311—see FIG. 78), and a particular container compartment assembly 300 that may be configured to house a liquid or creamy product.

Figure 79:
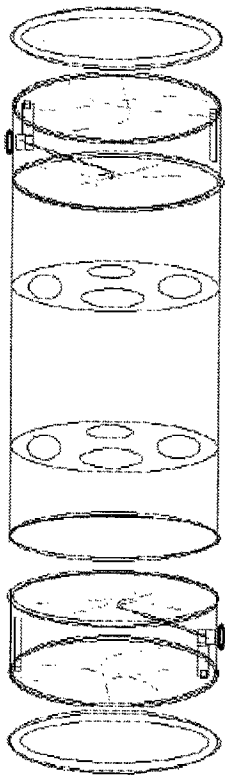
Figure 78:
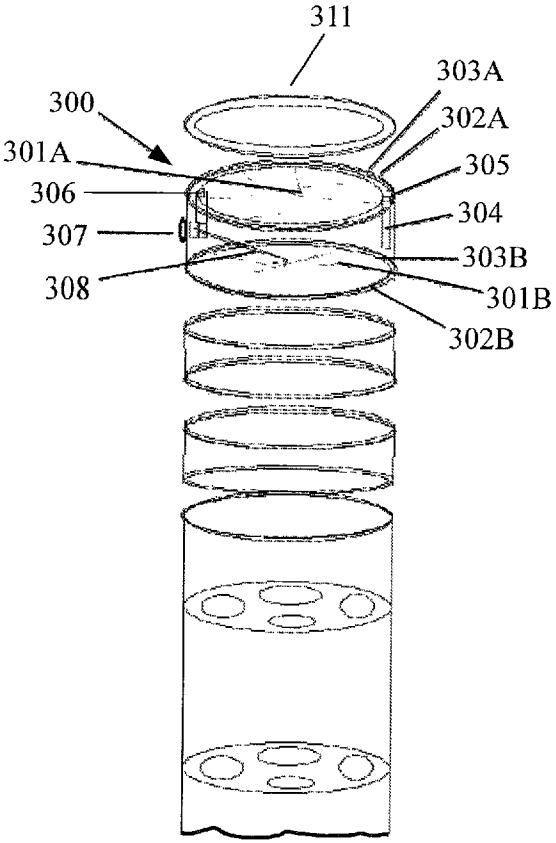
Figure 77:
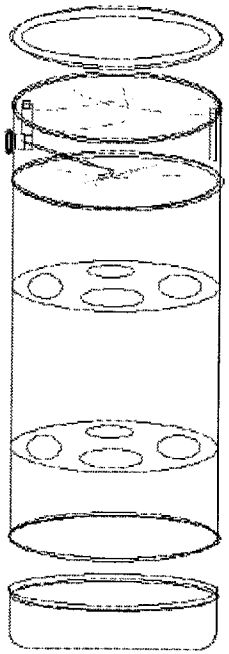

The container compartment assembly 300 may be utilized by itself without the other compartment layers (see FIG. 81), or it may be used on top of one of the other compartment layers and may serve as a cover. Moreover, the container compartment assembly 300 may be used in combination with any of the stackable compartments layers described herein, and can be placed anywhere within the container assembly, and may furthermore be amongst a mix of vertical and horizontal compartments. Also, as seen in FIG. 79, two or more container compartment assemblies 300 may be used in a stack of compartment layers.

The container compartments 300 may be configured to include any one of the fastening mechanisms disclosed herein to permit coupling and/or uncoupling to any of the one or more cosmetics compartment layers, and may therefore include threading 302A and 302B, or it may be hinged, etc.

Figure 81:
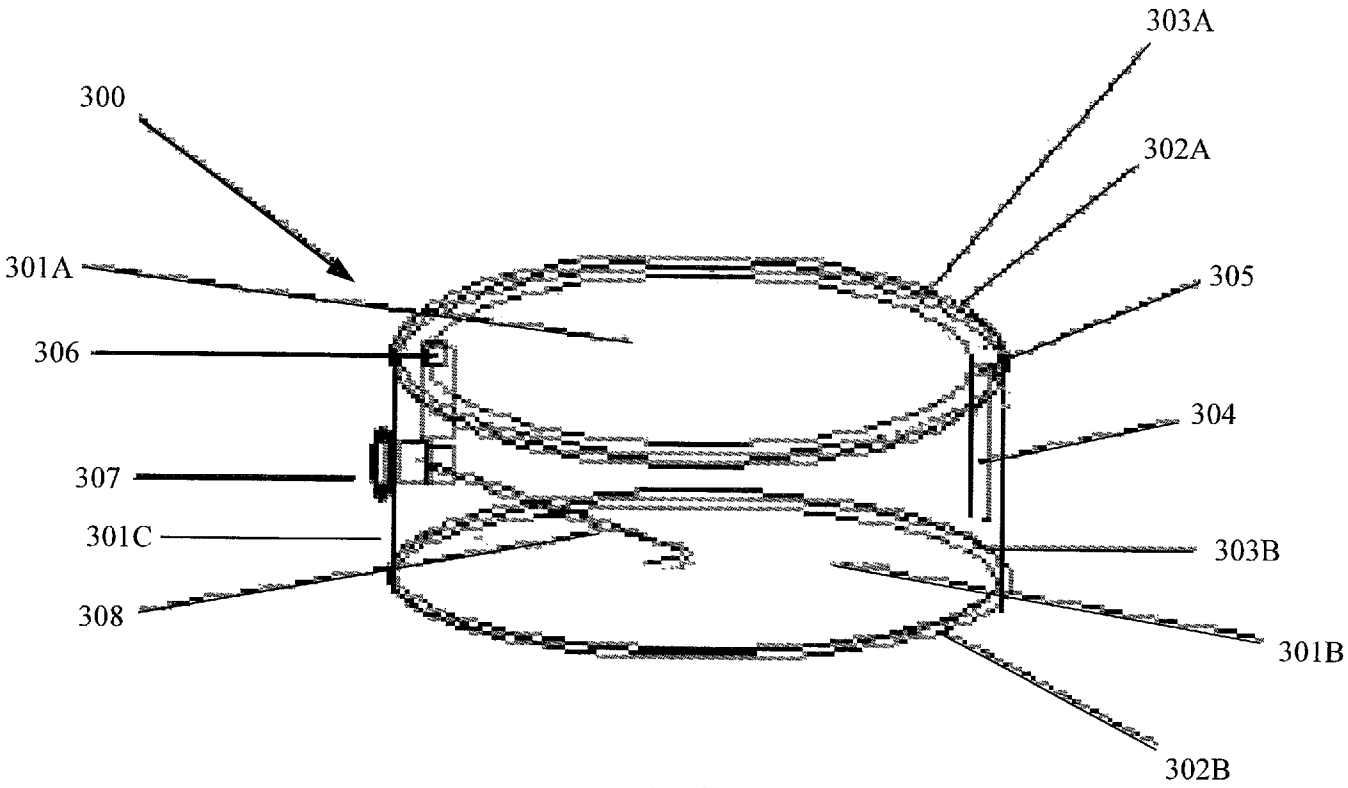

As seen in FIG. 81, the container compartment assembly 300 may be formed with a cylindrical side wall 301C, a top wall 301A, and a bottom wall 301B, which top and bottom walls may be flat, and may be sealed all around with respect to the side wall, to form a leak-proof container and to protect its contents.

The container compartment assembly 300 may be formed to include: a sprayer head 307, from which the liquid or cream may exit out of the interior of the container, and a sprayer button 306. The sprayer head 307 may be located on the side wall 301C of the container compartment assembly 300, and may be positioned proximate to one of the top/bottom walls, or may be at a central position on of the side wall.

The sprayer button 306 may be coupled to a valve piston, and toggling/pressing of the sprayer button may cause the valve piston to open to permit outflow of the product from the sprayer head 307. The sprayer button 306 may be recessed in the wall to protect it from unintended contact that may result in an undesired/untimely discharge of product from the container compartment assembly 300.

Any suitable valve known in the art may be used, including, but not limited to, the valve and arrangement of U.S. Pat. No. 7,226,231 to Py for "Piston-Type Dispenser with One-Way Valve for Storing and Dispensing Metered Amounts of Substances." The valve may be open to the interior of the container, or in another embodiment, the valve may be in fluid communication with a hose/tube 308 that is positioned within the interior of the container 300 where the product is located. So when the sprayer button 306 is pressed, product may travel through the hose/tube 308, through the valve, and be discharged out of the sprayer head 307. The product within the container compartment assembly 300 may gravity flow through the tube and the valve, to be discharged out the sprayer head 307. Additionally, or alternatively, the product may be stored within the container compartment assembly 300 under pressure, which may permit or assist the discharge of the product out of the sprayer head 307.

The container compartment assembly 300 may also be formed to include a re-fill tube 304 that has one end coupled to an opening 305 in the container compartment assembly 300, and may have the other end disposed within the interior of the container, to allow liquid or cream to pass into the container in order to refill it. The container compartment assembly 300 may also have another valve, being a one-way valve, which is positioned at the opening 305, which valve may be normally closed, and which may be opened only when the container is being refilled. The product may be added therein under pressure or via gravity flow.

The container compartment assembly 300 may be formed to accommodate dispensing of any type of liquid, cream, jelly, paste, perfume, hand sanitizer, lotion, shampoo, or any other product that may flow. The dispensing may be in the form of a spray, a mist, a jet, a stream, a foam, or any other desirable finial.

Any suitable sprayer head 307, hose/tube, sprayer button 306, re-fill opening, valves, etc., may be used for the container compartment assembly 300, and is not limited to what is illustrated in the figures or which may be described herein. Also, the distance between the top wall 301A and bottom wall 301B, and the diameter of the side wall 301C can vary, and the shapes that are illustrated may vary as well, and are not limited to what is illustrated and described herein, which is merely meant to be illustrative.

What is claimed is:

1. A modular multi-layer multi-compartment cosmetics container assembly configured for interchangeability, said modular multi-layer multi-compartment cosmetics container assembly comprising:

one or more cosmetics compartment layers, each comprising:

a containment wall and a side wall, with a first end of said side wall joined to said containment wall, and with a second end of said side wall forming an opening defining a cavity configured to house a cosmetic product;

a hinge knuckle disposed proximate to said first end of said side wall, said hinge knuckle comprising:

a hole; and a slotted opening, said slotted opening configured to interconnect with said hole;

a recess formed proximate to said second end of said side wall;

a hinge pin, said hinge pin configured to extend across at least a portion of said recess;

a lid layer, said lid layer comprising:

a hinge knuckle, said hinge knuckle of said lid layer comprising:

a hole; and a slotted opening configured to interconnect with said hole of said lid layer;

wherein said hinge knuckle of said lid layer is configured to releasably and pivotally couple onto said hinge pin of an uppermost layer of said one or more cosmetics compartment layers; and a latch configured to releasably secure said lid layer to said uppermost layer of said one or more cosmetics compartment layers, when said lid layer is pivoted into a closed lid position.

2. The modular multi-layer multi-compartment cosmetics container assembly according to claim 1, wherein when said one or more cosmetics compartment layers comprises two or more of said cosmetics compartment layers, said hinge knuckle of a first one of said two or more cosmetics compartment layers is releasably and pivotally coupled to said hinge pin of an adjacent one of said two or more cosmetics compartment layers; and wherein each of said two or more of said cosmetics compartment layers further comprises: a latch configured to secure each of said two or more of said cosmetics compartment layers in a closed compartment layer position.

3. The modular multi-layer multi-compartment cosmetics container assembly according to claim 2, wherein said hinge knuckle of each of said two or more cosmetics compartment layers is configured to pivot from an extended knuckle position, permitting said releasable coupling to said hinge pin of an adjacent layer of said two or more cosmetics compartment layers, into a retracted knuckle position;

wherein said latch of each of said two or more cosmetics compartment layers is configured to pivot from an extended latch position, permitting said securement in the closed compartment layer position, into a retracted latch position.

4. The modular multi-layer multi-compartment cosmetics container assembly according to claim 3, wherein when said hinge knuckle of a bottommost layer of said two or more cosmetics compartment layers is pivoted into said retracted knuckle position, and when said latch of said bottommost layer of said two or more cosmetics compartment layers is pivoted into said retracted latch position, a lower surface of said bottommost layer is flat and without any protruding features.

* * * * *